US005731812A

United States Patent [19]

Herrington

[11] Patent Number: 5,731,812

[45] Date of Patent: Mar. 24, 1998

[54] LIQUID CRYSTAL DISPLAY (LCD) PROTECTION CIRCUIT

[75] Inventor: Daniel R. Herrington, Burleson, Tex.

[73] Assignee: National Semiconductor Corp., Santa Clara, Calif.

[21] Appl. No.: 452,094

[22] Filed: May 26, 1995

[51] Int. Cl.[6] ..... G09G 3/00

[52] U.S. Cl. ..... 345/211; 361/89; 326/104; 327/142

[58] Field of Search ..... 345/211, 212, 345/213, 87; 361/59, 75, 89; 326/93, 96, 104; 327/141, 142, 143; 359/36, 37, 55; 364/707

[56] References Cited

U.S. PATENT DOCUMENTS

| | | | |
|---|---|---|---|
| 4,538,197 | 8/1985 | Breen | 361/75 |
| 5,189,319 | 2/1993 | Fung et al. | 307/452 |
| 5,204,953 | 4/1993 | Dixit | 395/400 |
| 5,254,888 | 10/1993 | Lee et al. | 307/480 |
| 5,259,006 | 11/1993 | Price et al. | 375/107 |
| 5,404,473 | 4/1995 | Papworth et al. | 395/375 |
| 5,408,626 | 4/1995 | Dixit | 395/400 |

FOREIGN PATENT DOCUMENTS

| | | |
|---|---|---|
| 3807020 | 9/1989 | Germany . |
| 4269707 | 9/1992 | Japan . |
| 4366892 | 12/1992 | Japan . |
| 2106690 | 4/1983 | United Kingdom . |

OTHER PUBLICATIONS

Serra, Michaela & Devisoglu, Bulent I, "Testing", Chapter 79, *The Electrical Engineering Handbook*, Richard C. Dorf, Editor-in-Chief, pp. 1808–1837, CRC Press.

L-T Wang et al., "Feedback Shift Registers For Self-Testing Circuits", *VLSI Systems Design*, Dec. 1986.

Masakazu Shoji, "CMOS Dynamic Gates", Chapter 5, *AT&T CMOS Digital Circuit Technology*, Prentice Hall, 1988, pp. 210–257.

Guthrie, Charles, "Power-On Sequencing For Liquid Crystal Displays; Why, When, And How", *Sharp Application Notes*, Sharp Corporation, 1994, pp. 2–1 thru 2–9.

Bernd Moeschen, "NS32SP160—Feature Communication Controller Architecture Specification", *National Semiconductor*, Rev. 1.0, May 13, 1993.

Agarwal, Rakesh K., *80×86 Architecture and Programming, vol. II: Architecture Reference*, Chap. 4, Prentice Hall, 1991, pp. 542–543.

Intel486 Microprocessor Family Programmer's Reference Manual, Intel Corporation, 1993.

"8237A High Performance Programmable DMA Controller (8237A, 8237A-4, 8237A-5)", *Peripheral Components*, Intel, 1992, pp. 3–14 thru 3–50.

Kane, Gerry, "R2000 Processor Programming Model", Chapter 2, *MIPS RISC Architecture*, MIPS Computer Systems, Inc.

Hennessy, John, et al., "Intepreting Memory Addresses", *Computer Architecture A Quantitative Approach*, pp. 95–97, Morgan Kaufmann Publishers, Inc. 1990.

(List continued on next page.)

*Primary Examiner*—Richard Hjerpe
*Assistant Examiner*—Lun-Yi Lao
*Attorney, Agent, or Firm*—Limbach & Limbach

[57] ABSTRACT

A display protection circuit includes a first OR gate which receives a first pulse at one input and a first clock signal at another input. A second OR gate receives the first pulse at one input and a second clock signal at another input. A first monostable multivibrator is coupled to the first OR gate and receives an output of the first OR gate and generates a second pulse in response thereto. A second monostable multivibrator is coupled to the second OR gate and receives an output of the second OR gate and generates a third pulse in response thereto. A first logic gate is coupled to the first and second monostable multivibrators and generate a fourth pulse which changes state in response to one of the first and second clock signals stopping transitioning for a first predetermined period of time.

11 Claims, 25 Drawing Sheets

OTHER PUBLICATIONS

Intel Corp. Microsoft Corp., *Advanced Power Management (APM) BIOS Interface Specification*, Revision 1.1, Sep. 1993.

*PowerPC601 Reference Manual*, IBM, 1994, Chapter 9, "System Interface Operation", pp. 9–15 thru 9–17.

Intel Corporation, *i486 Micro Processor Hardware Reference Manual*, Processor Bus, pp. 3–28 thru 3–32.

KEY TO FIGURE 1

| | |
|---|---|
| FIG. 1A | FIG. 1B |

KEY TO FIGURE 2

| | |
|---|---|
| FIG. 2A | FIG. 2B |

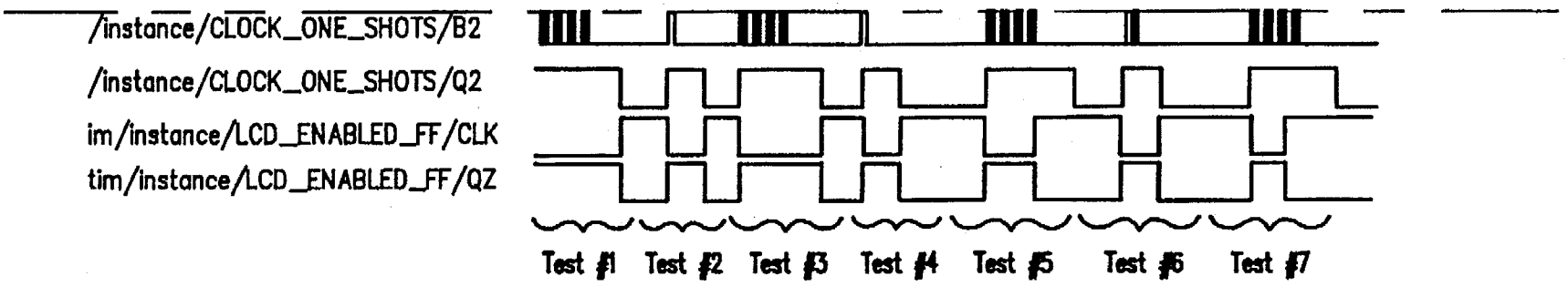
THIS IS THE ENTIRE SIMULATION, WHICH CONSISTS OF SEVEN DISCRETE TESTS.
THESE TESTS ARE ENLARGED ON THE FOLLOWING SEVEN PAGES.
FIG. 4B
KEY TO FIGURE 4
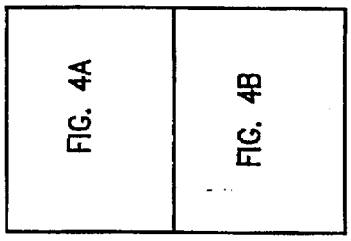

TEST #1: THIS TEST JUST GOES THROUGH A NORMAL SEQUENCE:
SYSTEM RESET (XRESET_Z PULSES LOW)
ENABLE VDD (WRITE A "1" TO VDD_EN)
START CLOCKS (80 CL1'S, 1 CL2, 80 CL1'S, 1 CL2,...)
STOP CLOCKS
DISABLE VDD (WRITE A "0" TP VDD_EN)

KEY TO FIGURE 5

| FIG. 5A | FIG. 5B |
|---|---|

TEST #2: THIS TEST SHOWS THAT THE LCD PROTECTION CIRCUITRY NEEDS RESET BEFORE VDD OR THE CLOCKS CAN BE RE-ENABLED.

1. ATTEMPT TO WRITE A "1" TO VDDEN FAILS.
2. WRITE A RST_LCD_Z PULSE (JUST m I/O WRITE TO
3. NOW ATTEMPT TO WRITE "1" TO VDD_EN SUCCEEDS.

TEST #3: THIS TEST SHOWS THAT VDD_EN WILL BE RESET TO "0" IF THE CLOCKS ARE STARTED AND THEN STOPPED.

1. CLOCKS ARE BOTH STARTED.
2. CLOCKS ARE BOTH STOPPED
3. VDD_EN IS RESET TO "0".

KEY TO FIGURE 7

TEST #4: THIS TEST SHOWS THAT IF CL2 IS STARTED BUT CL1 IS NOT, THEN VDD_EN WILL BE RESET TO "0". NOTE THAT CL2 WILL BE GATED OFF WHENEVER VDD_EN = "0".

1. CL2 IS STARTED, BUT NOT CL1.
2. VDD_EN IS RESET TO "0".
3. THIS PORTION OF CL2 WILL BE GATED OFF WHEN VDD_EN IS RESET TO "0".

KEY TO FIGURE 8

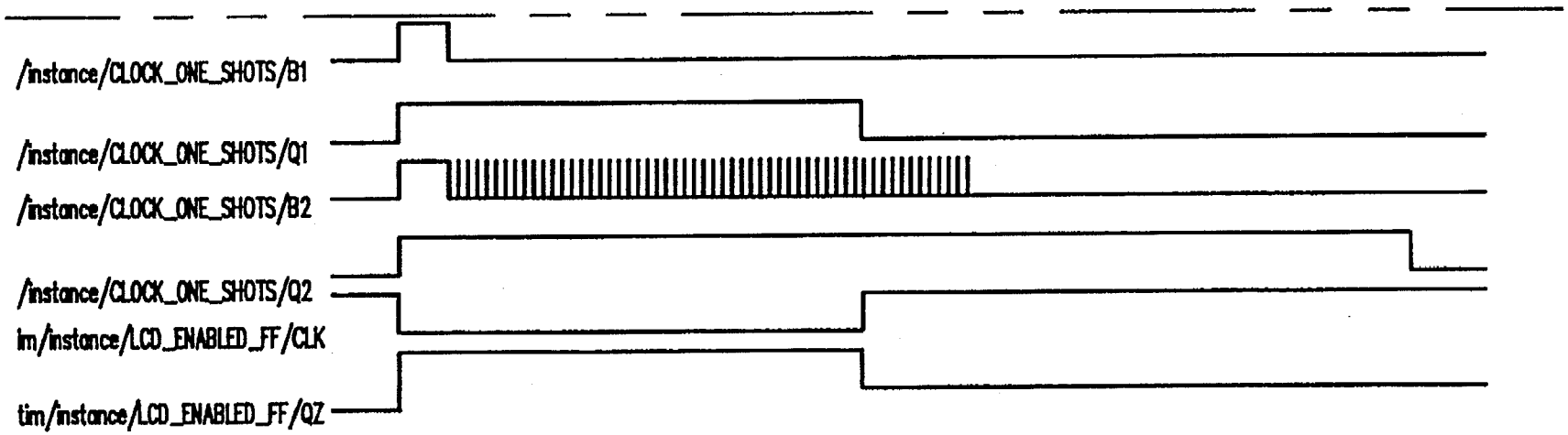
TEST #5: THIS TEST SHOWS THAT IF CL1 IS STARTED BUT CL2 IS NOT, THEN VDD_EN WILL BE RESET TO "0".
1. CL1 IS STARTED, BUT NOT CL2.
2. VDD_EN IS RESET TO "0".
3. THIS PORTION OF CL1 WILL BE GATED OFF WHEN VDD_EN IS RESET TO "0".
FIG. 9B
INDEX TO FIGURE 9
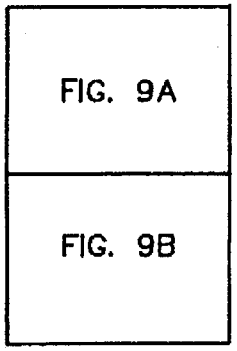

TEST #6: THIS TEST SHOWS THAT IF BOTH CLOCKS ARE STARTED AND THEN CL1 IS STOPPED, VDD_EN WILL BE RESET TO "0".

1. BOTH CL1 AND CL2 ARE STARTED.
2. CL1 IS STOPPED.
3. VDD_EN IS RESET TO "0".

KEY TO FIGURE 10

| FIG. 10A | FIG. 10B |
|---|---|

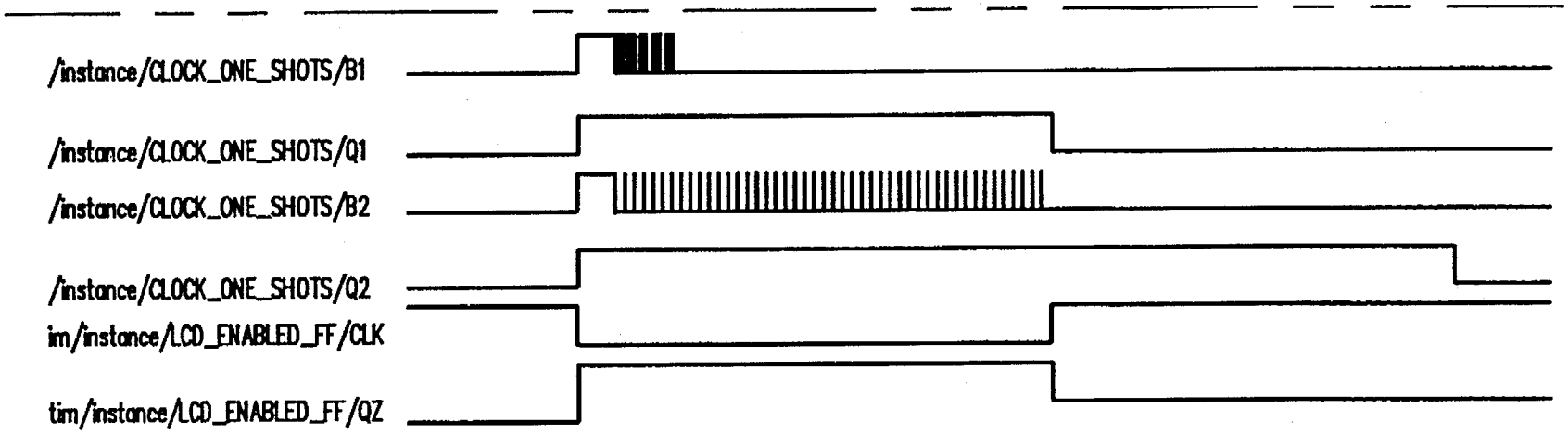
TEST #7: THIS TEST SHOWS THAT IF BOTH CLOCKS ARE STARTED AND THEN CL2 IS STOPPED, VDD_EN WILL RESET TO "0".
1. BOTH CL1 AND CL2 ARE STARTED.
2. CL2 IS STOPPED.
3. VDD_EN IS RESET TO "0".
FIG. 11B
KEY TO FIGURE 11
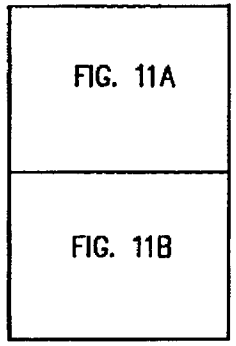

LIQUID CRYSTAL DISPLAY (LCD) PROTECTION CIRCUIT

BACKGROUND OF THE INVENTION

1. Field of the Invention

The present invention relates to liquid crystal displays (LCD), and more particularly, to an LCD protection circuit.

2. Description of the Related Art

Liquid crystal displays (LCD) are increasingly being used in computer applications, such as for example, laptop, notebook, and pen based computers. Such displays are popular because they are reliable, power efficient, compact, light weight, and easily installed in hardware. LCDs vary from simple one line monochrome units, up to full page graphic displays having both monochrome and color formats.

LCDs require special considerations upon power-up (or "power-on"). A power-up sequencing is typically used to protect the liquid crystal from exposure to any DC voltage, i.e., VEE. Specifically, when powering-up the display, the VDD voltage supply is normally started first. This allows the on-board logic to become active to start an internal clock which sets up an AC wave form on the display electrodes before being exposed to VEE. Without the internal clock started first, even a very short interval of exposure to VEE can cause the liquid crystal to begin to break down and change state. Such a change of state can cause a change in color of the liquid crystal and eventually the formation of gas bubbles. When this happens, the damage is permanent and the display will eventually be rendered useless.

The internal clock is often controlled using a phase lock loop circuit. When VDD is started, the internal clock begins oscillating and resonates between VDD and VEE. As the voltage for VEE is increased, the display gains contrast. The contrast on the display is optimized by adjusting VEE. After VDD has stabilized, the external clock and data signals may be introduced to the display module. After the clock and data signals are stable, VEE can be turned on.

Different types of LCDs use different power-up sequences. Two different types of LCDs are 1) passive, and 2) active matrix. The operating voltage of a passive display is higher than the DC breakdown voltage of the liquid crystal fluid. Again, the objective during power-up is to apply VDD to start the internal clock first to insure stable operation of the CMOS circuitry prior to introduction of the logic signals. The internal clock sets up an AC wave form which prevents DC current from flowing through the liquid crystal. Even a small DC voltage for a short period of time can cause a breakdown of the liquid crystal material and eventually render the display useless.

Damage to an LCD can also result from a system halt or a software bug that causes the LCD to be improperly powered-down and then subsequently improperly powered back up. In order to prevent damage to the LCD from such unpredictable events, circuits have been developed which provide protection to the LCD in such an event. Previous circuits used to provide protection to LCDs have several disadvantages. First, such circuits do not permit widely configurable timing intervals and have no external timing circuitry. Second, they will often only work with a few LCD controllers and passive displays. Third, some are integrated solutions with specialize components. Finally, they do not provide protection against LCD clocks/data being accidentally restarted after removal of LCD voltage supplies.

Thus, there is a need for an LCD protection circuit which overcomes the disadvantages discussed above.

SUMMARY OF THE INVENTION

The present invention provides a display protection circuit. A first OR gate receives a first pulse at one input and a first clock signal at another input. A second OR gate receives the first pulse at one input and a second clock signal at another input. A first monostable multivibrator is coupled to the first OR gate and receives an output of the first OR gate and generates a second pulse in response thereto. A second monostable multivibrator is coupled to the second OR gate and receives an output of the second OR gate and generates a third pulse in response thereto. A first logic gate is coupled to the first and second monostable multivibrators and generate a fourth pulse which changes state in response to one of the first and second clock signals stopping transitioning for a first predetermined period of time.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

FIGS. 4A–11B are timing diagrams illustrating the operation of the LCD protection circuit shown in FIG. 1.

DETAILED DESCRIPTION OF THE PREFERRED EMBODIMENT

Figure 1A:
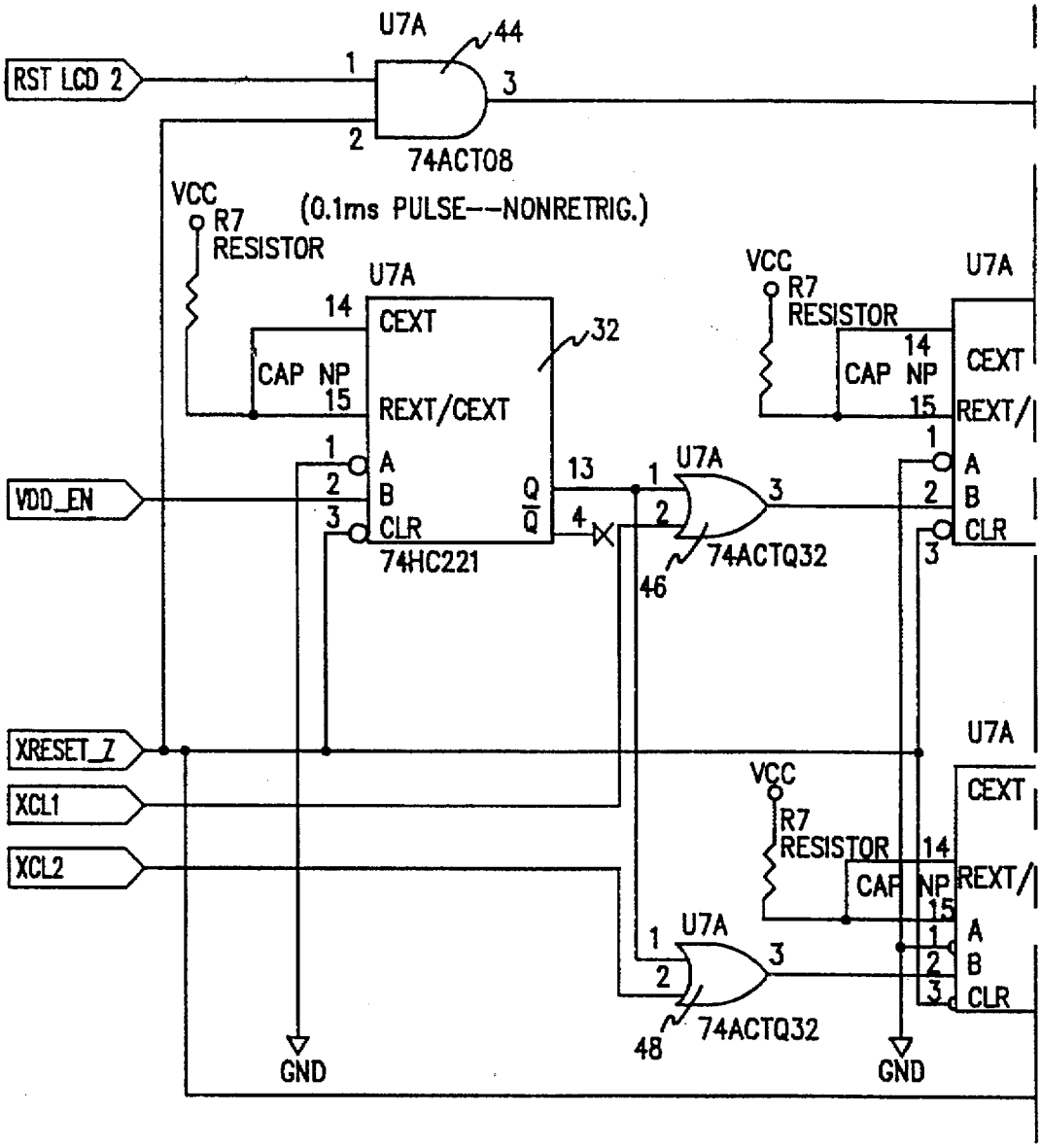
FIGS. 1A and 1B are schematic diagrams illustrating an LCD protection circuit in accordance with the present invention.
Figure 1B:
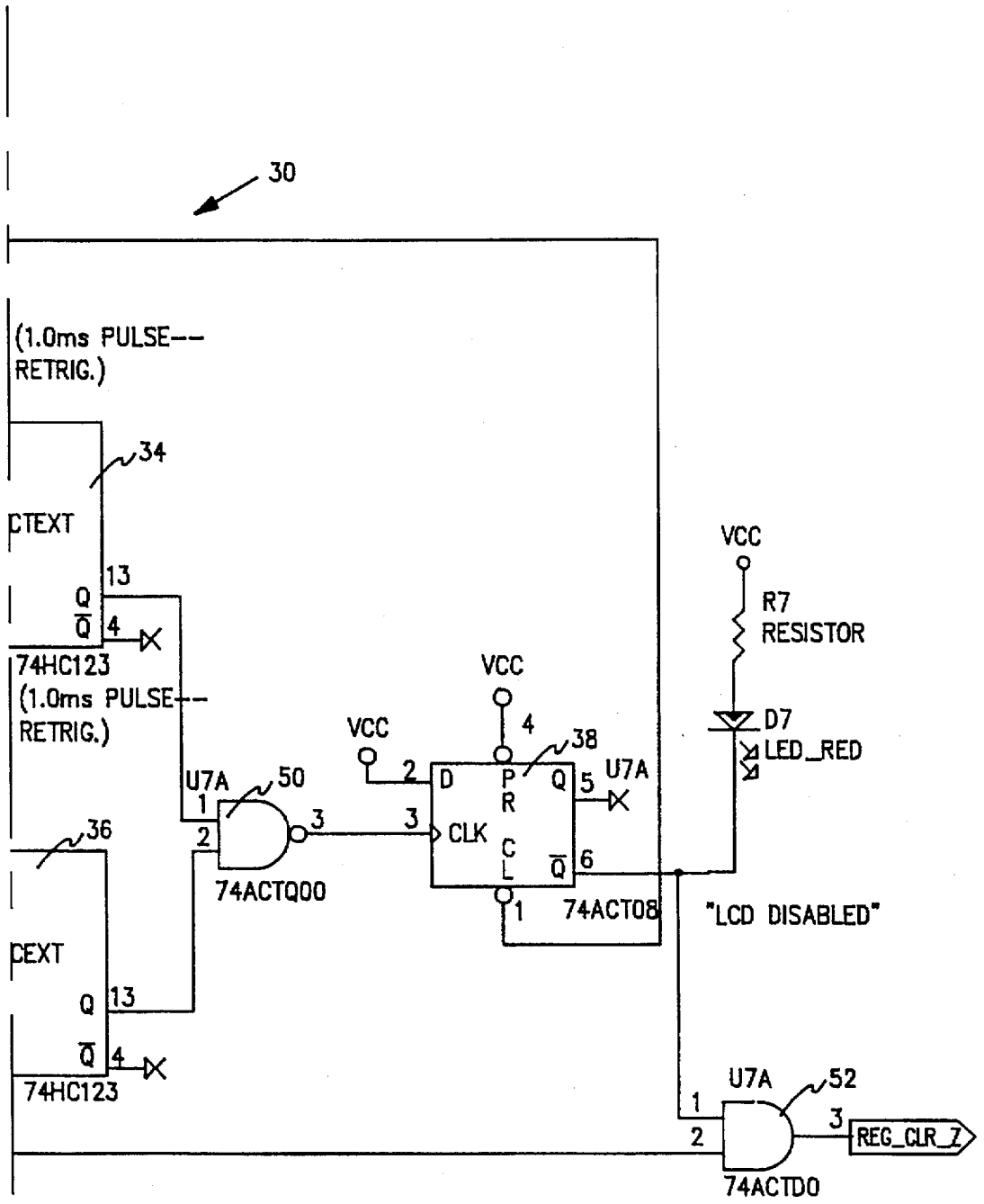
Figure 2A:
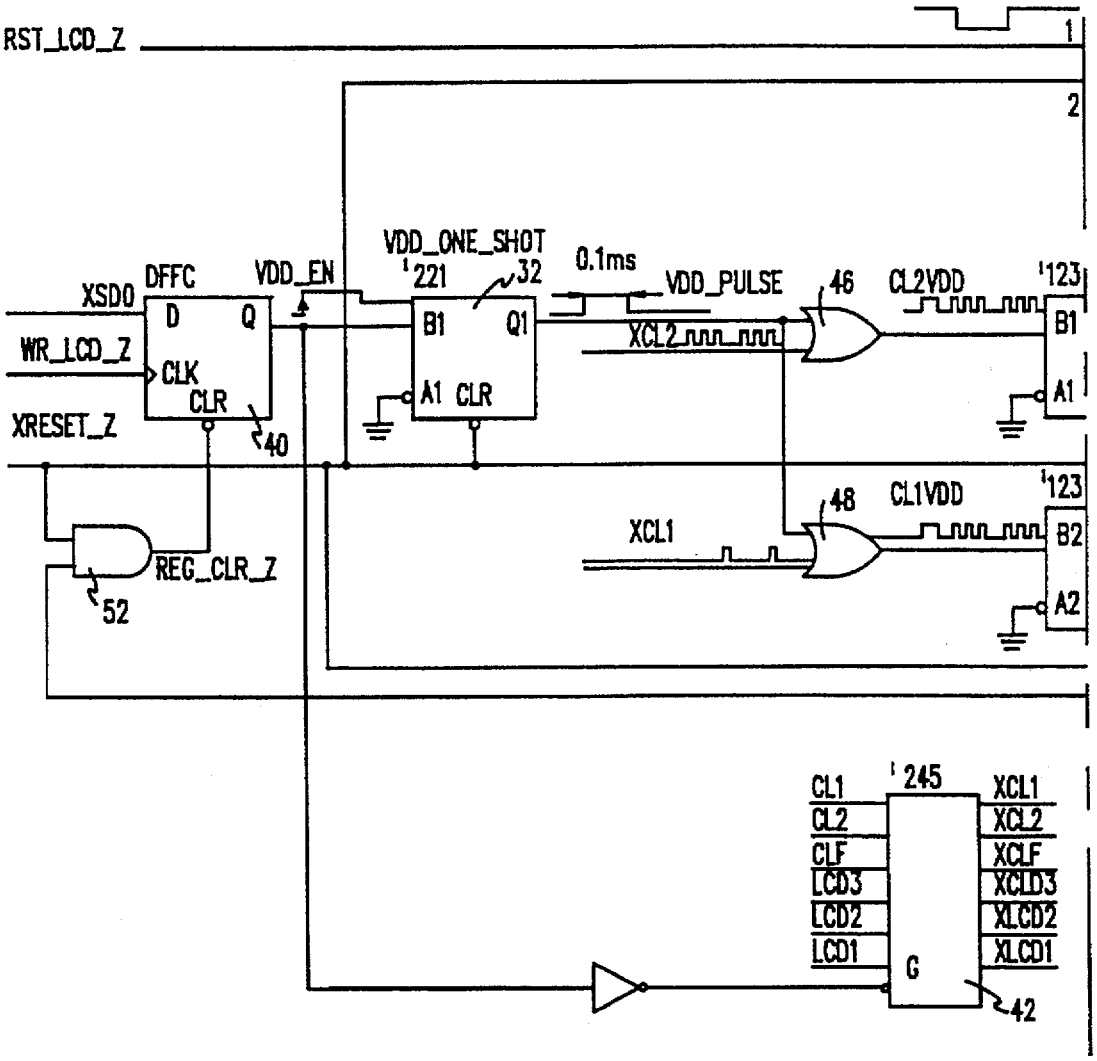
FIGS. 2A and 2B are schematic diagrams illustrating the LCD protection circuit shown in FIG. 1.
Figure 2B:
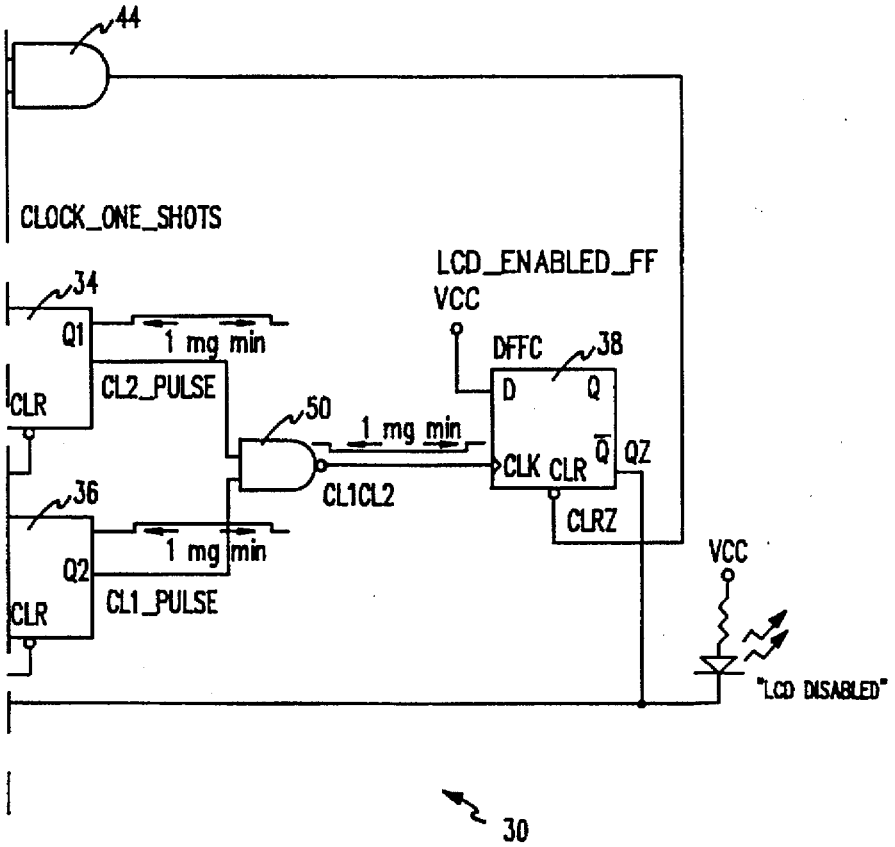
Figure 3A:
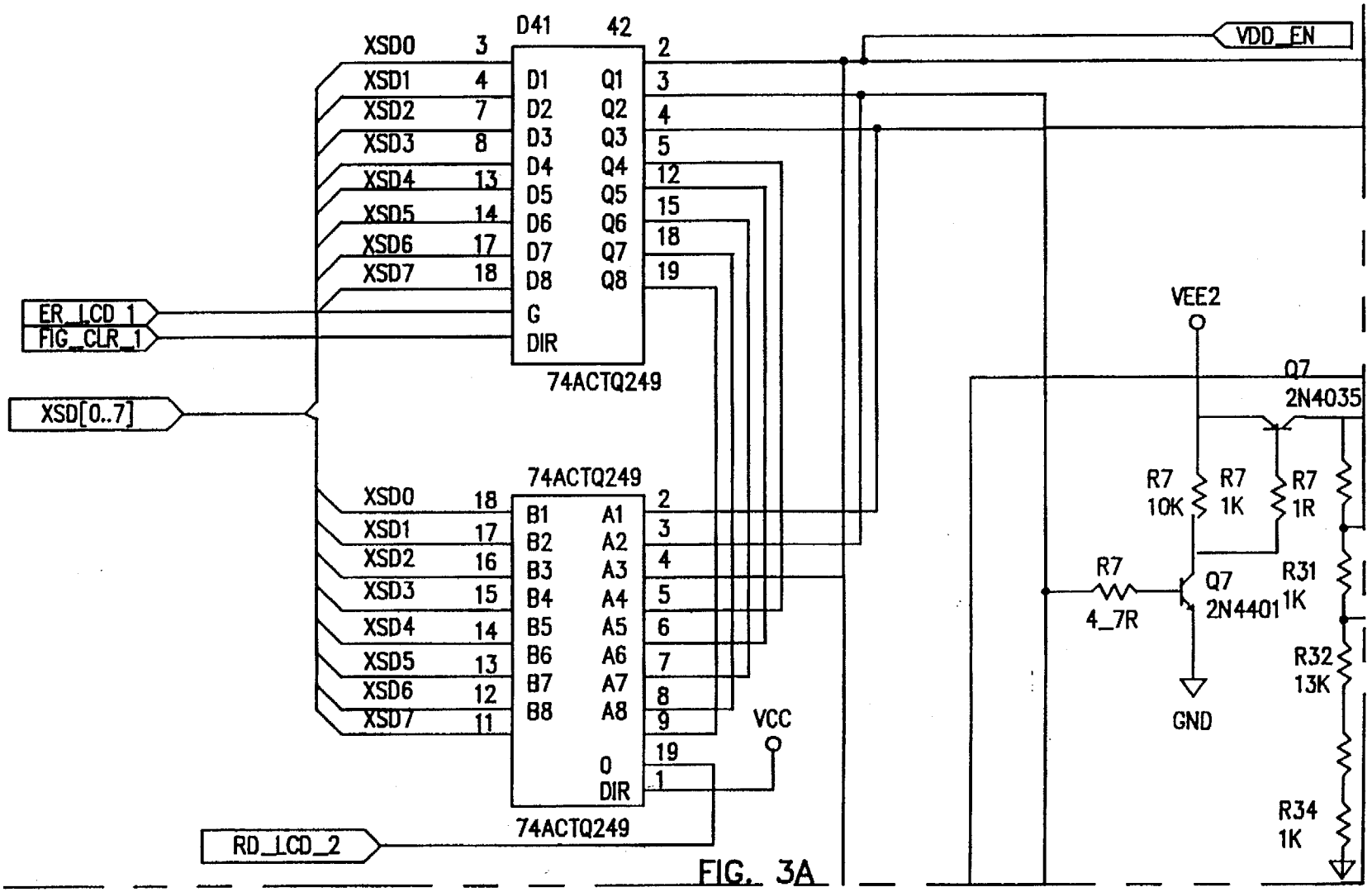
FIGS. 3A–3D are schematic diagrams illustrating circuitry that may be used with the LCD protection circuit shown in FIGS. 1A and 1B.
Figure 3B:
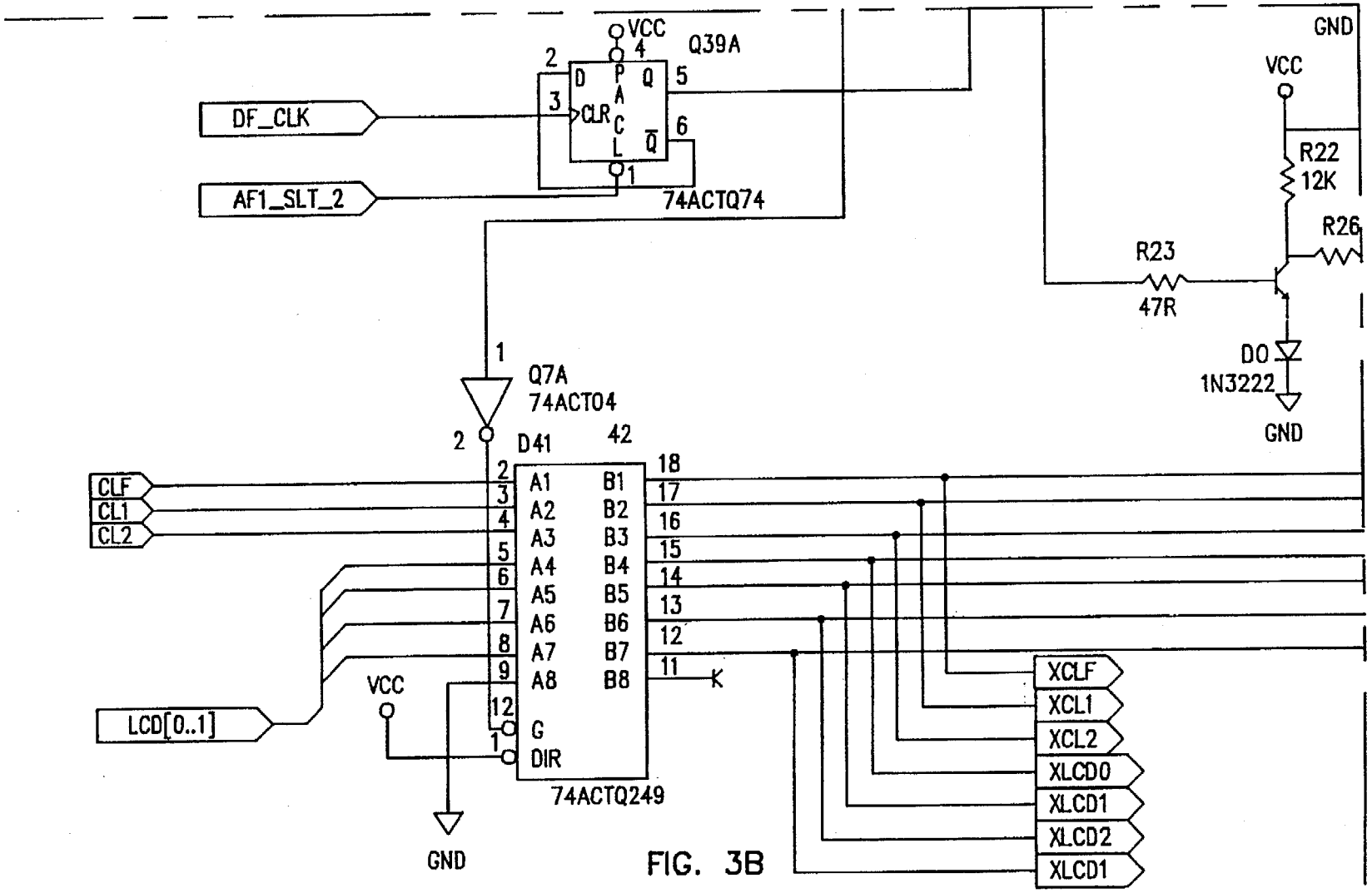
Figure 3C:
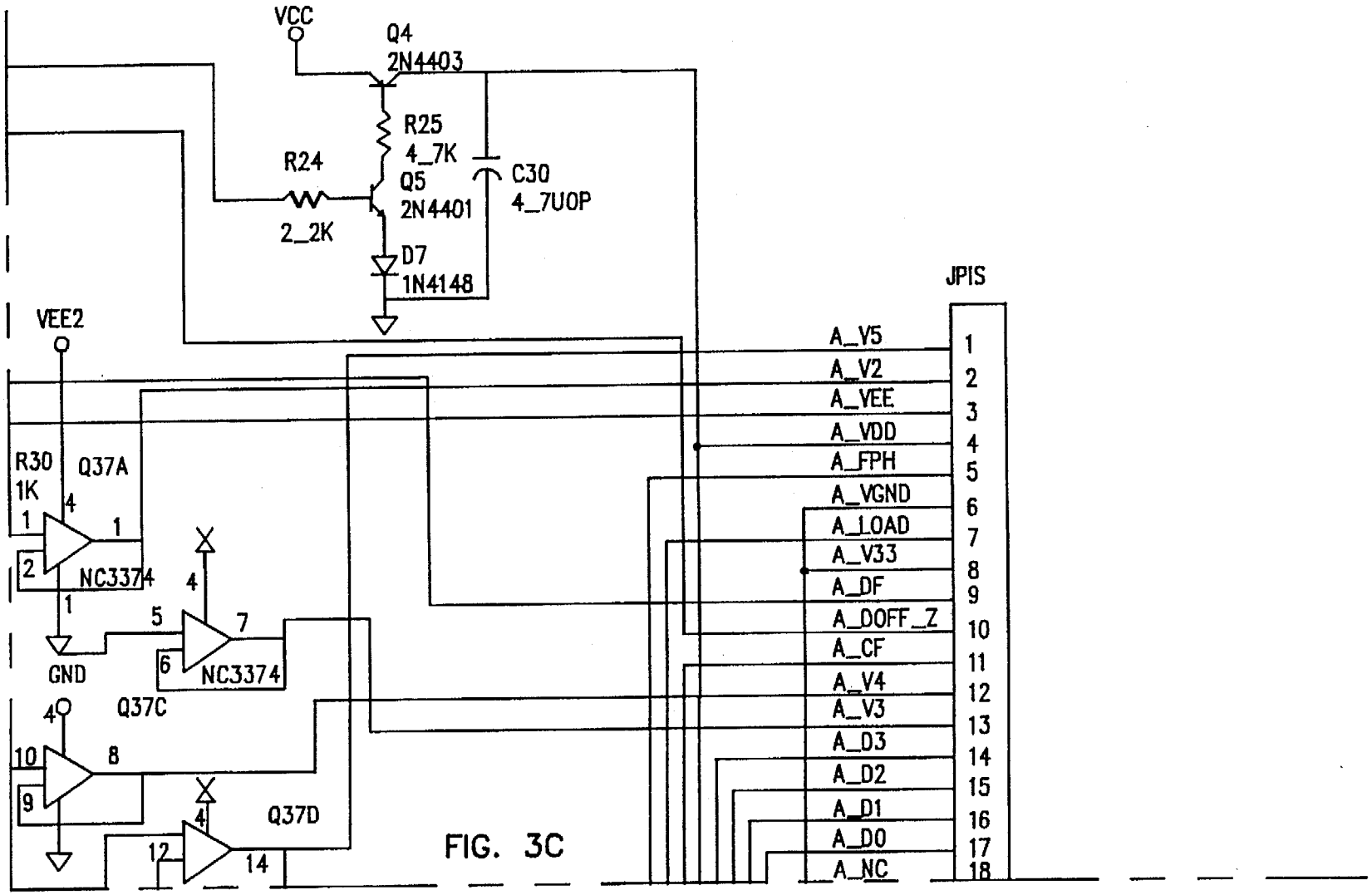
Figure 3D:
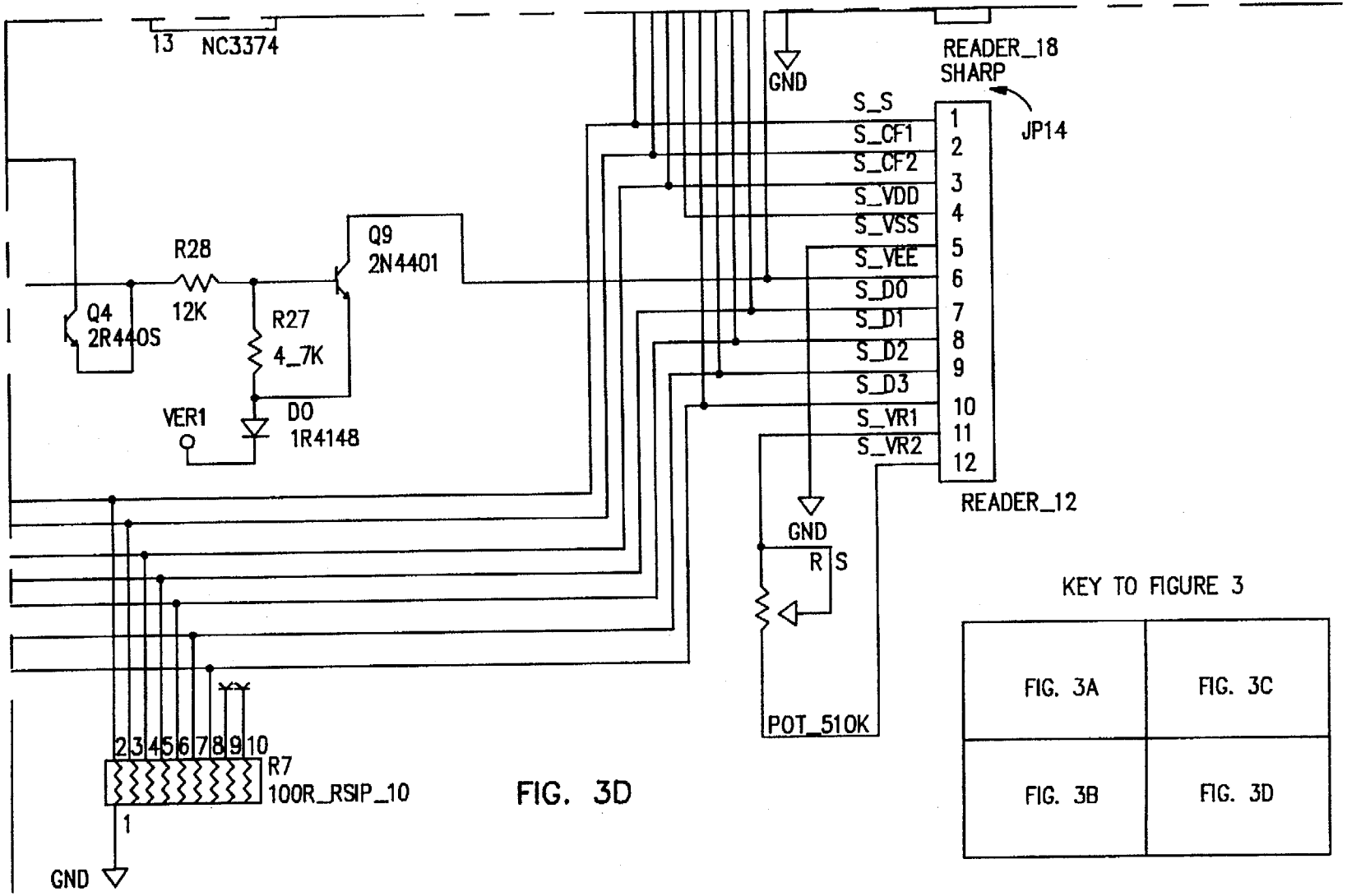
Figure 4A:
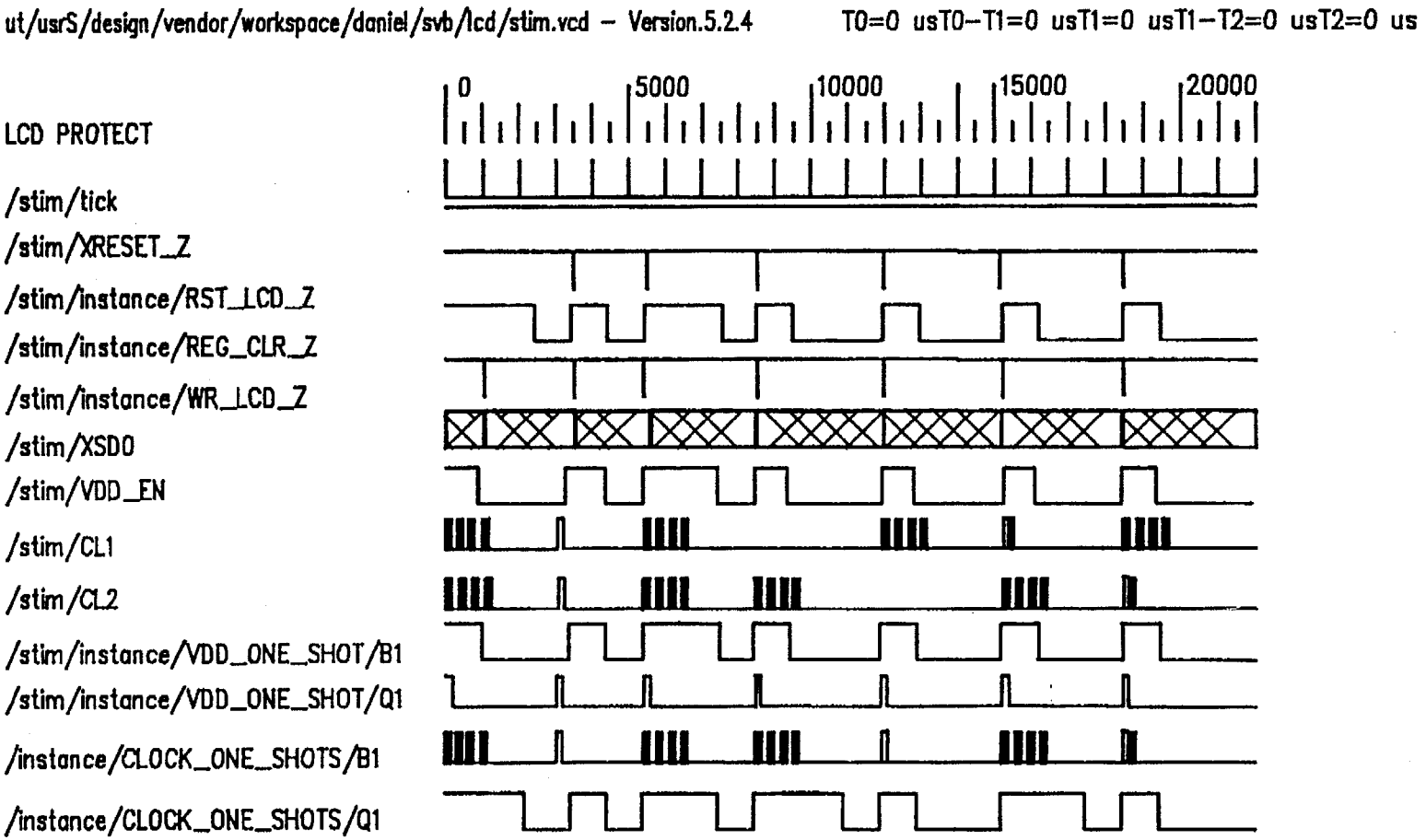
Figure 5A:
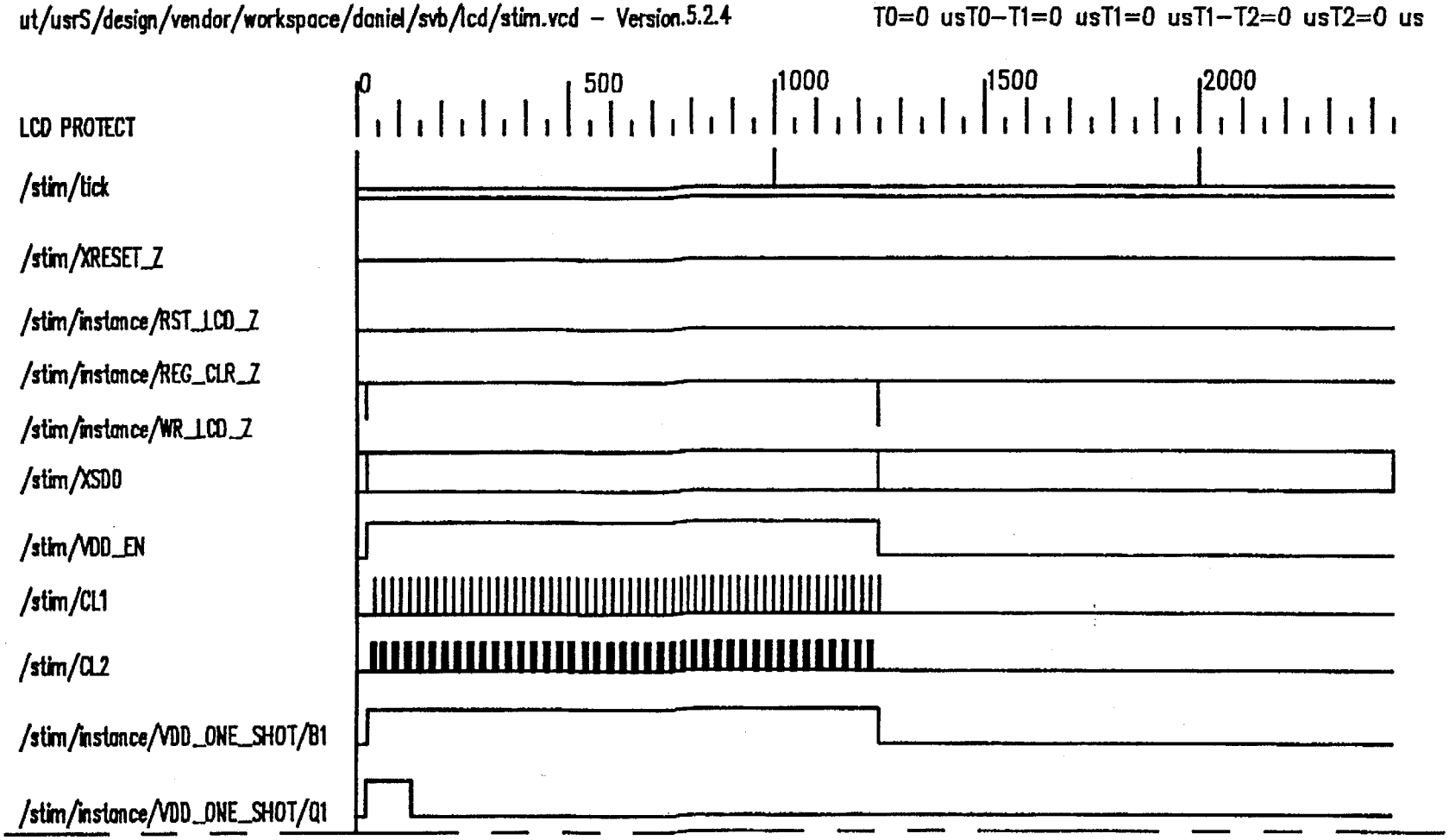
Figure 5B:
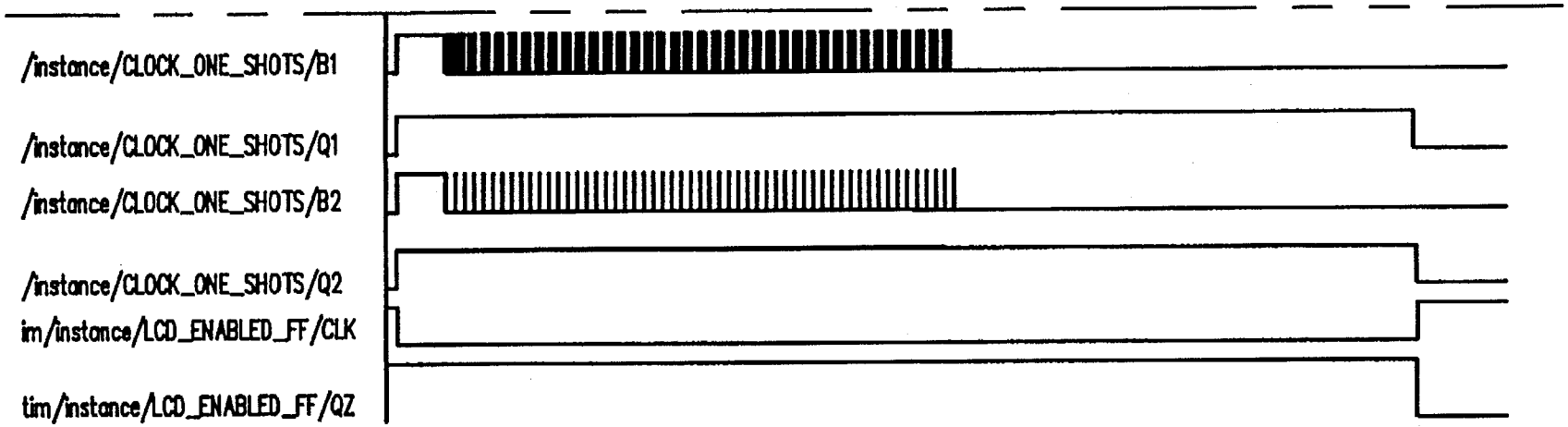
Figure 6A:
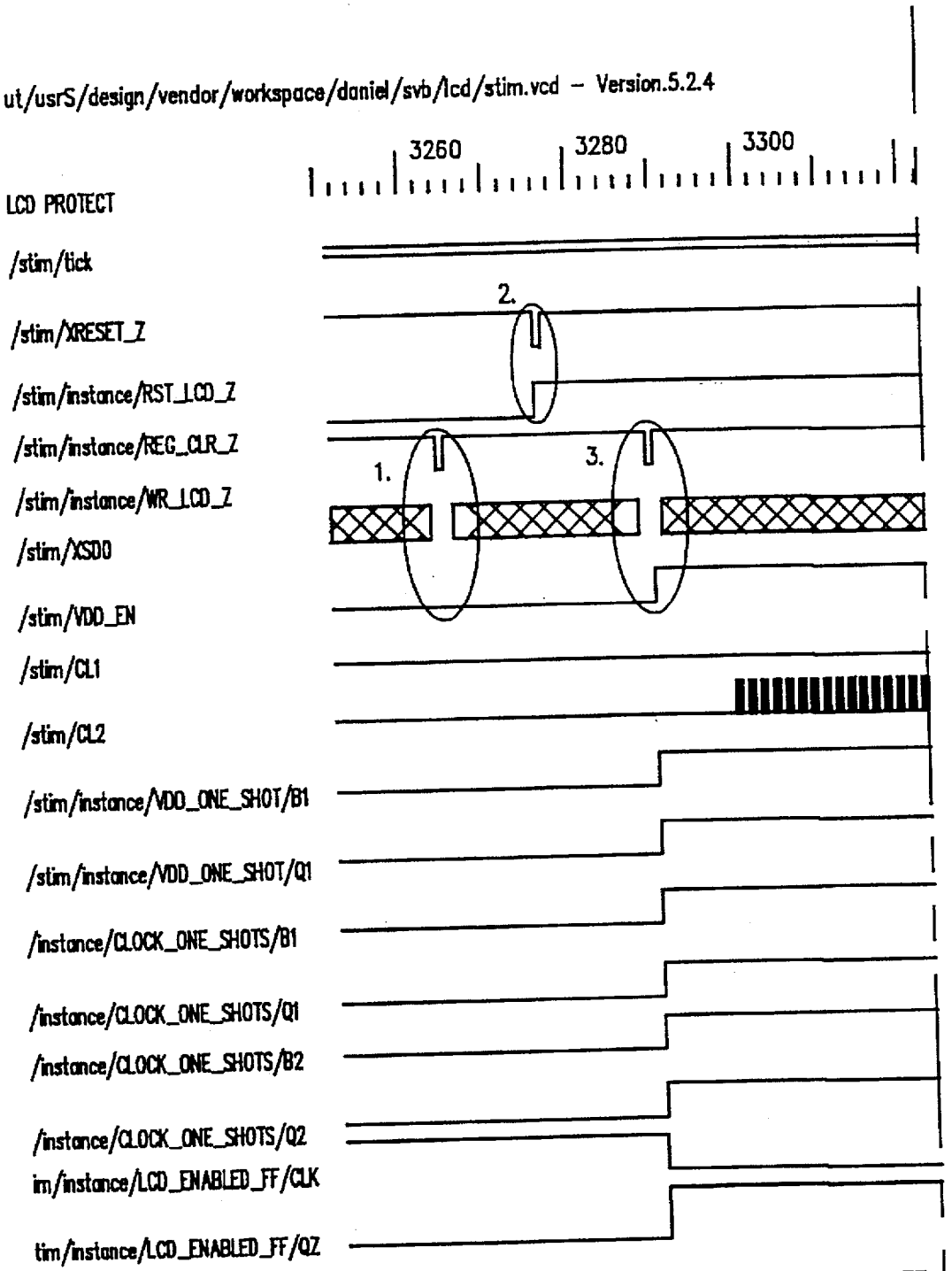
Figure 6B:
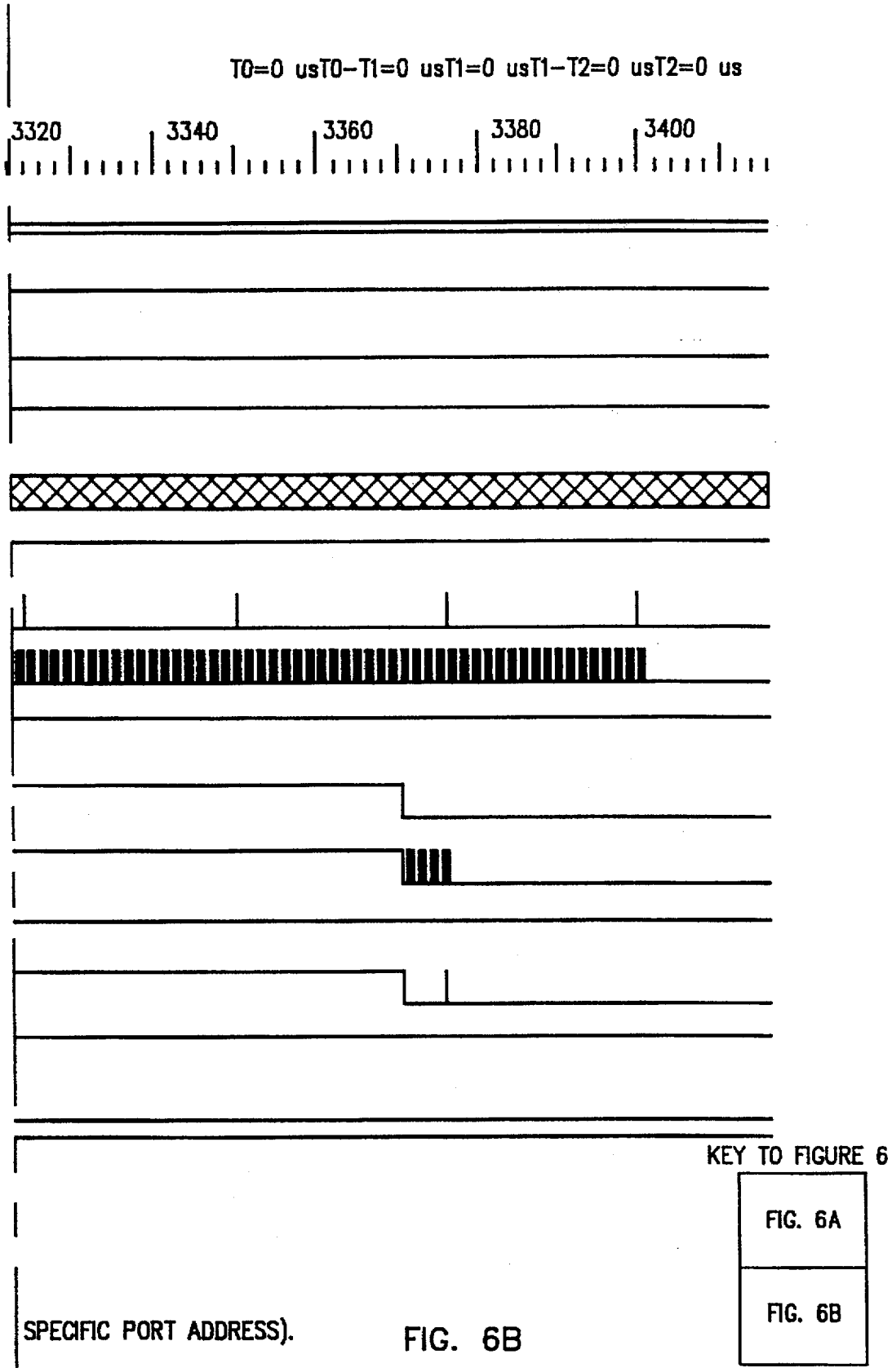
Figure 7A:
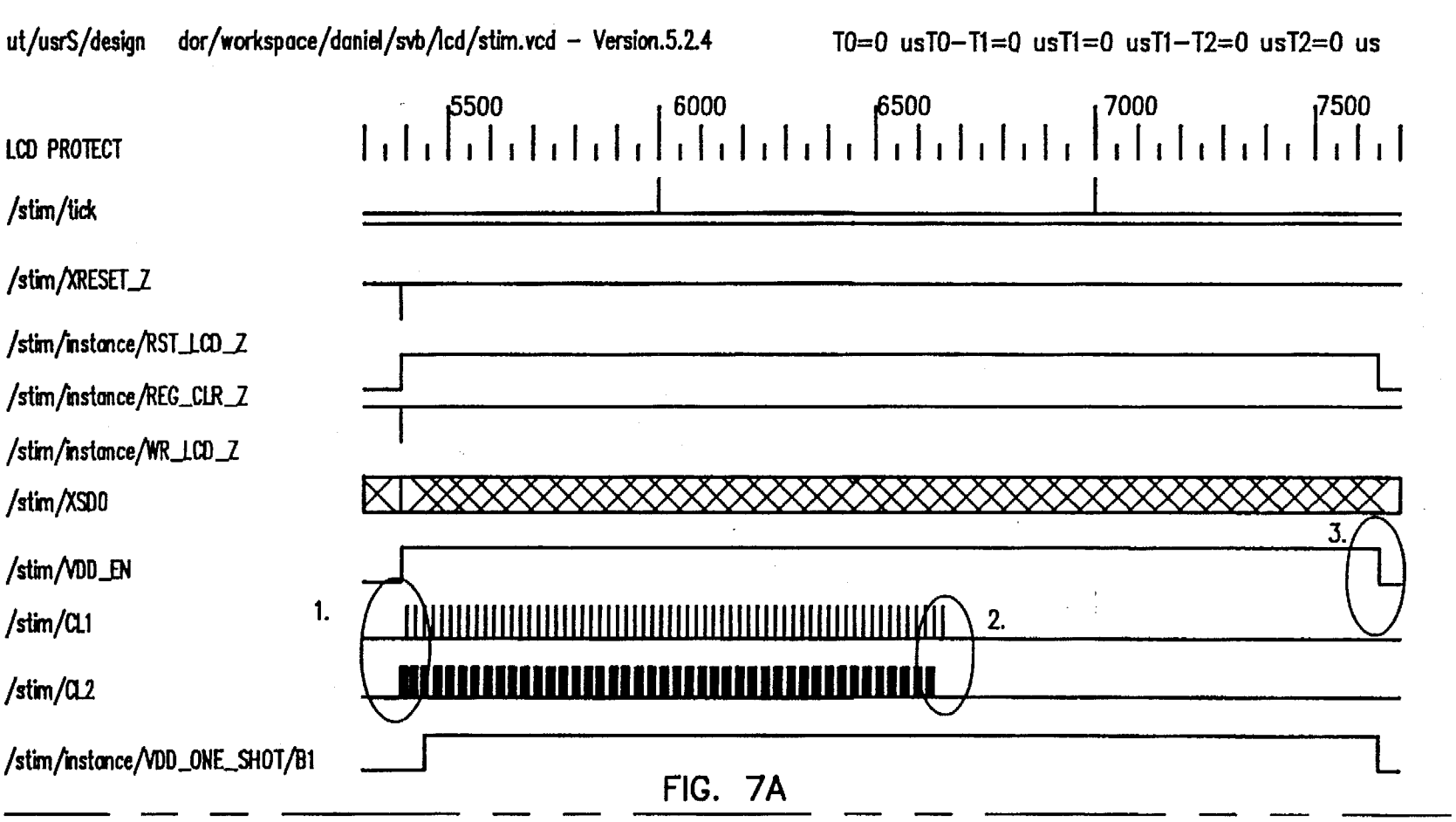
Figure 7B:
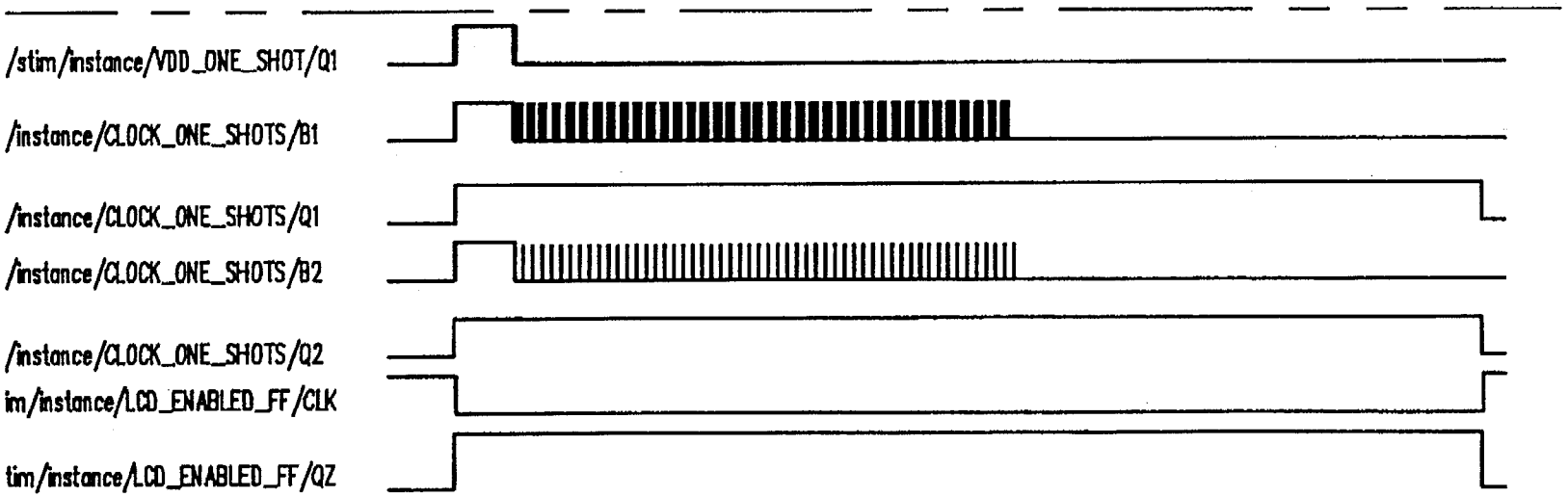
Figure 7B:
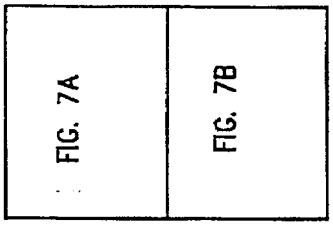
Figure 8A:
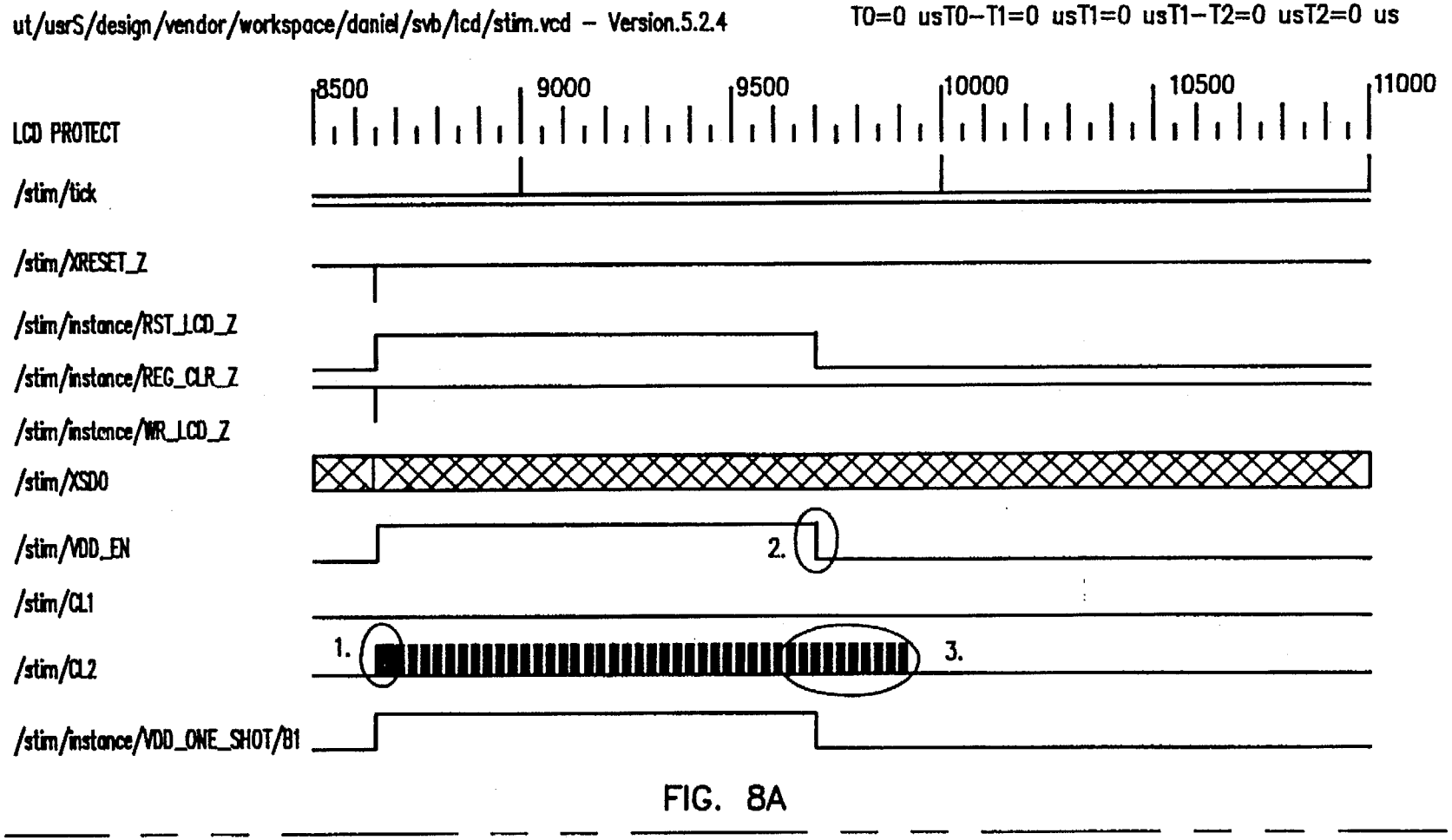
Figure 8B:
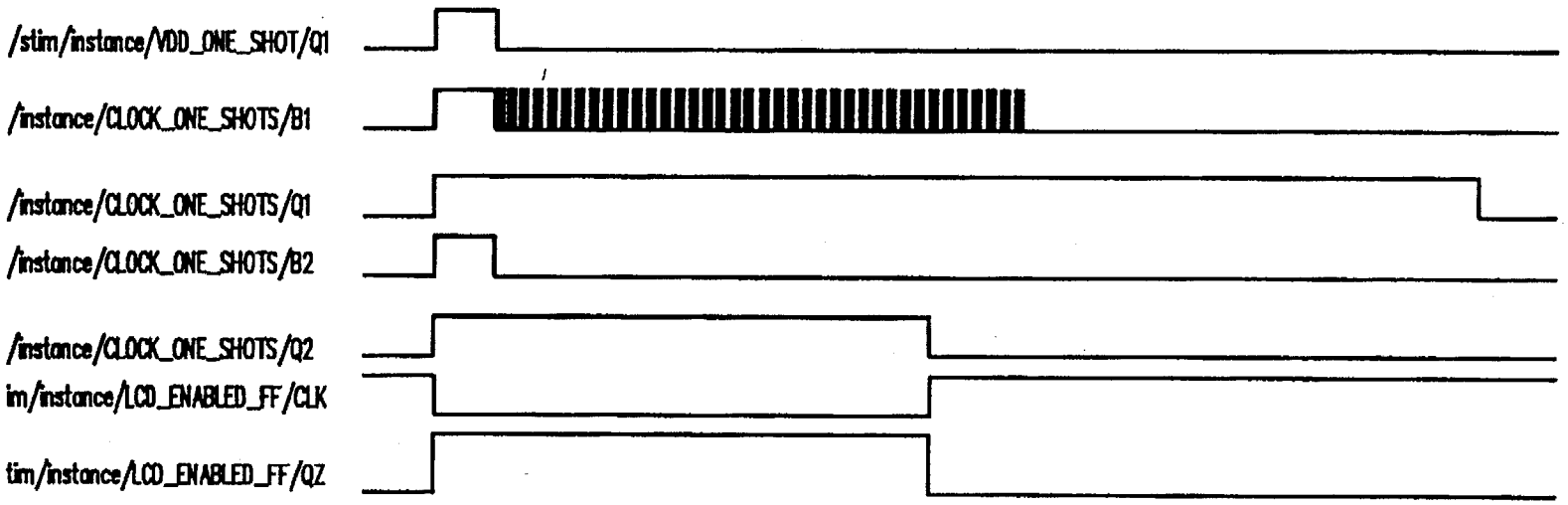
Figure 8B:
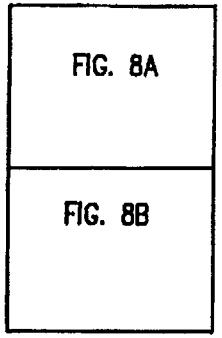
Figure 9A:
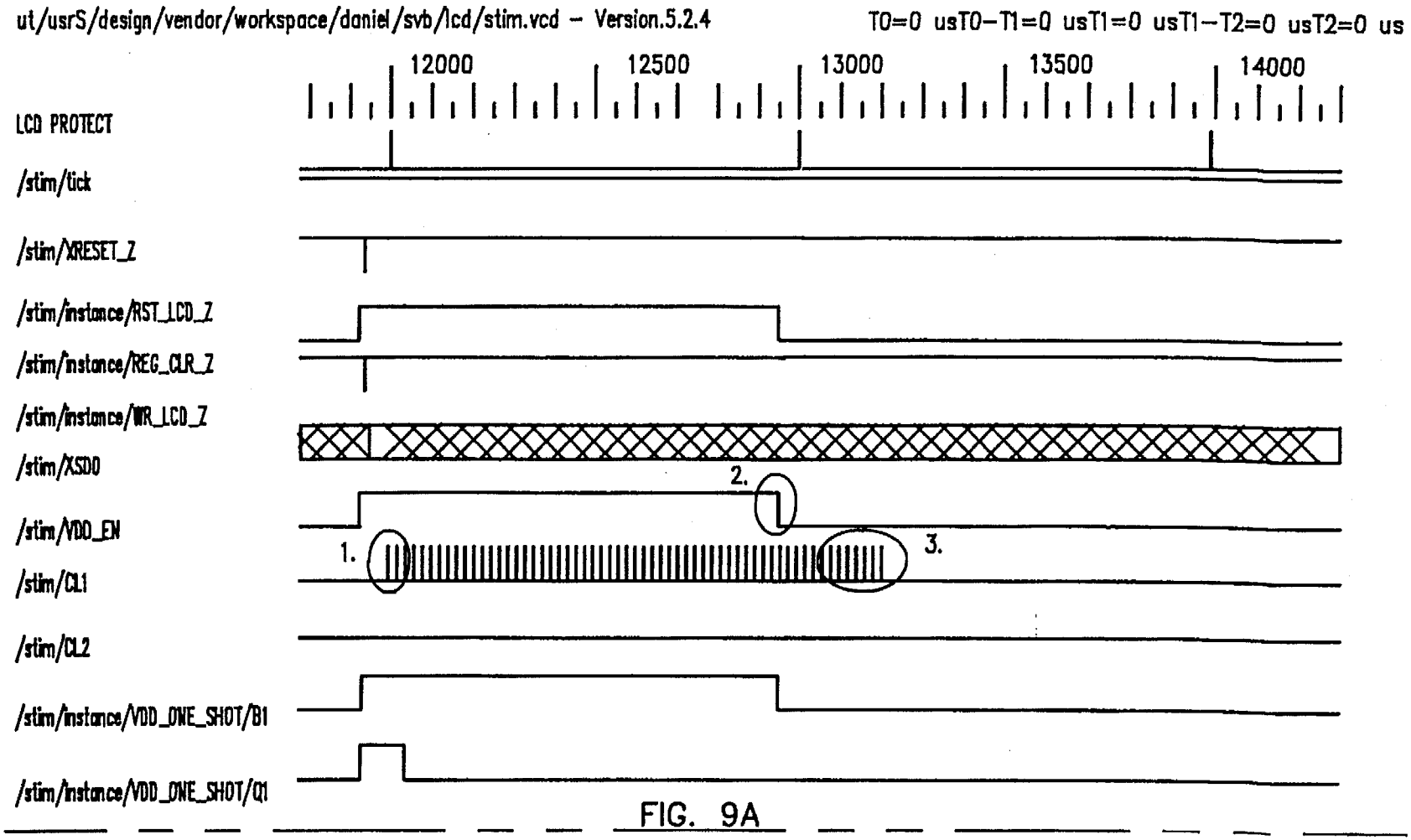
Figure 10A:
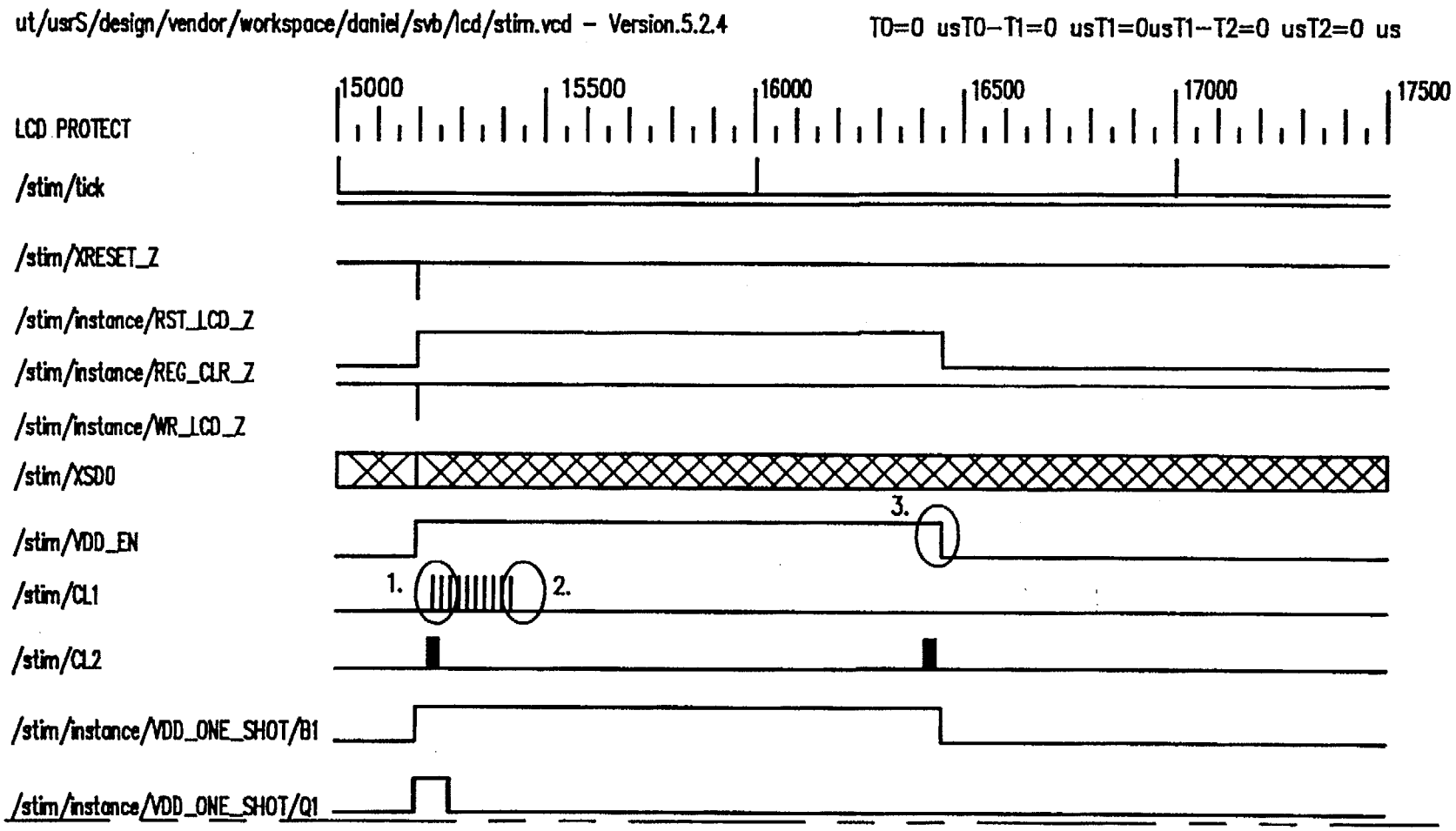
Figure 10B:
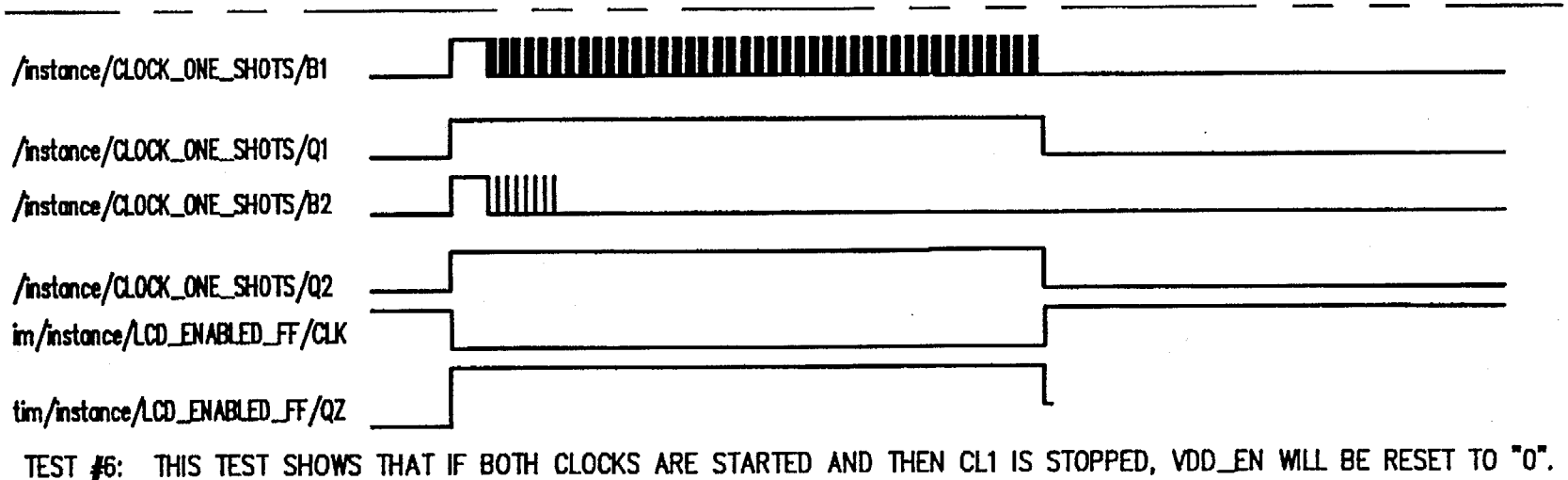
Figure 11A:
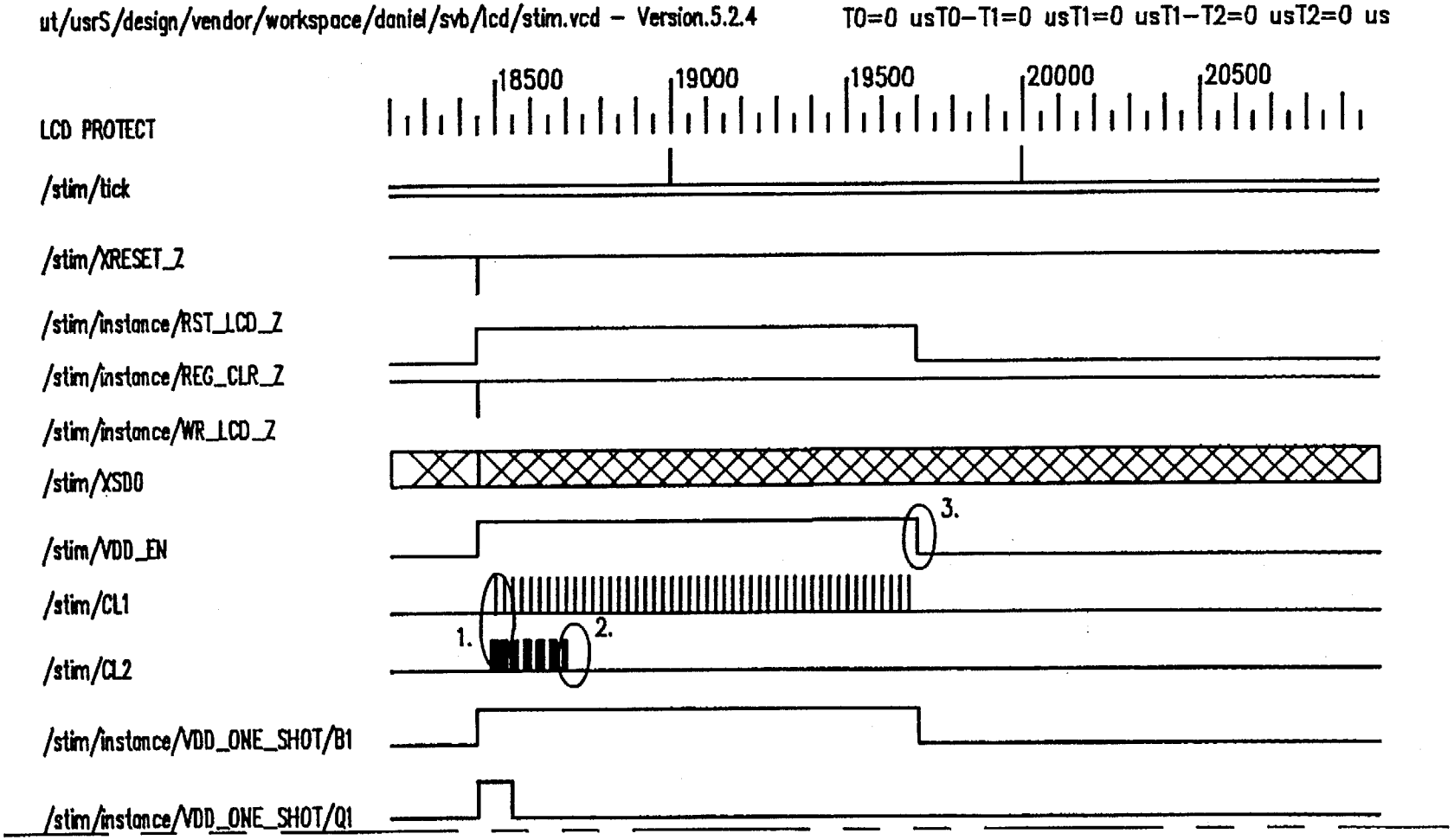

Referring to FIGS. 1–3, there is illustrated an LCD protection circuit 30 in accordance with the present invention. The LCD protection circuit 30 prevents damage to a passive LCD panel in the event of a system halt or a software bug. Specifically, LCD protection circuit 30 enables clock and data buffers to the LCD panel when the VDD_enable register is set (when VDD is turned on). It then resets the VDD_enable register (turning VDD off), resets the VEE_enable register (turning VEE off), and disables the LCD clock and data buffers under either of the following conditions: (1) one of the clock signals stops transitioning; (2) one of the clocks has not started transitioning after a specified amount of time.

The LCD protection circuit 30 allows widely configurable timing intervals. It will work with many different LCD controllers and passive displays, ranging from 320×200 to SVGA resolution, and it uses standard logic integrated circuits (ICs) and standard passive components. Furthermore, the LCD protection circuit 30 gives protection against LCD clocks/data being accidentally restarted after removal of LCD voltage supplies.

The LCD protection circuit 30 may be used with a system having a CPU and an LCD controller. The LCD controller generates a row clock CL1, a dot clock CL2, a frame signal CLF, and data signals LCD[3:0], and provides these signals to an LCD panel.

The LCD protection circuit 30 includes one non-retriggerable monostable multivibrator 32 (or "one-shot 32"), two retriggerable one-shots 34 and 36, one D flip-flop 38, two OR gates 46 and 48, two AND gates 44 and 52, and a NAND gate 50, all connected substantially as shown. For purposes of explanation, the timing resistor and capacitor values for the one shots have been chosen so that the one shot 32 produces a 0.1 ms pulse and the one shots 34 and 36 produce 1.0 ms pulses. It should be understood, however, that the timing resistor and capacitor values for the one shots may be changed without departing from the scope of the present invention.

The operation of the LCD protection circuit 30 will be discussed with reference to FIGS. 4–11. When the system $\overline{\text{RESET}}$ occurs (e.g., generated by an external CPU), all three on-shots 32, 34, and 36 are cleared. The user may then enable VDD to the LCD panel by setting VDD_EN=1. The VDD_EN signal is used to enable the clock and data buffers (buffered signals include XCL1, XCL2, XCLF, XLCD[3:0]), so that they are transmitted only when VDD is enabled. The rising edge of VDD_EN triggers the one shot 32. This one-shot 32 generates a 0.1 ms-long high pulse, VDD_PULSE. The VDD_PULSE signal enters the two OR gates 46 and 48, one with the buffered dot clock (XCL2), and the other with the buffered row clock (XCL1). The outputs of the OR gates 46 and 48 (CL2VDD and CL1VDD) are fed into the two one-shots 34 and 36.

The one-shots 34 and 36 each generate an independent 1.0 ms-long high pulse (CL2_PULSE and CL1_PULSE). These pulses are ANDed together and inverted by the NAND gate 50 to produce a low-going pulse ($\overline{\text{CL1CL2}}$). This low pulse is continued as long as both clocks continue to transition. However, if one clock stops transitioning for more than 2.0 ms, or does not start to transition after a maximum of 2.0 ms, the one shots 34 and 36 will time out and generate a rising edge on $\overline{\text{CL1CL2}}$. The rising edge of $\overline{\text{CL1CL2}}$ clocks a D flip-flop 38, whose active-low output is ANDed with $\overline{\text{RESET}}$ by the AND gate 52 to reset the VDD_EN signal. Resetting the VDD_EN signal in mm disables the VDD supply, the clock and data buffers, and the VEE supply. The D flip-flop 38 should be cleared before the user can attempt to enable the LCD power supplies, or data again.

A copy of a Verilog computer code listing which can be used to generate detailed schematics of an embodiment of the present invention is attached hereto as Appendix A and is incorporated herein by reference.

It is envisioned that the teachings of the present invention could also be applied to Thin Film Transistor (TFT) Active Matrix LCDs for use, for example, in office automation applications and audio visual applications.

One example use of the LCD protection circuit 30 is in a system such as that described in the data sheet entitled "Elentari Optimized 32-bit 486-class Controller With On-chip Peripherals for Embedded Systems", authored by National Semiconductor Corporation of Santa Clara, Calif., a copy of which is attached hereto as Appendix B and is incorporated herein by reference. The system described therein is a single IC chip having an on-board CPU, LCD controller, and other on-board peripherals. In such a system, a user should normally take care to power-up and power-down the LCD controller and the display panel in the proper sequence. Specifically, other peripherals and internal functional blocks can be enabled and configured for normal operation fairly easily, but the LCD controller does normally require special handling. Because of the nature of the LCD panels, care must be taken in applying the high voltages used in the display panels themselves.

Figure 12:
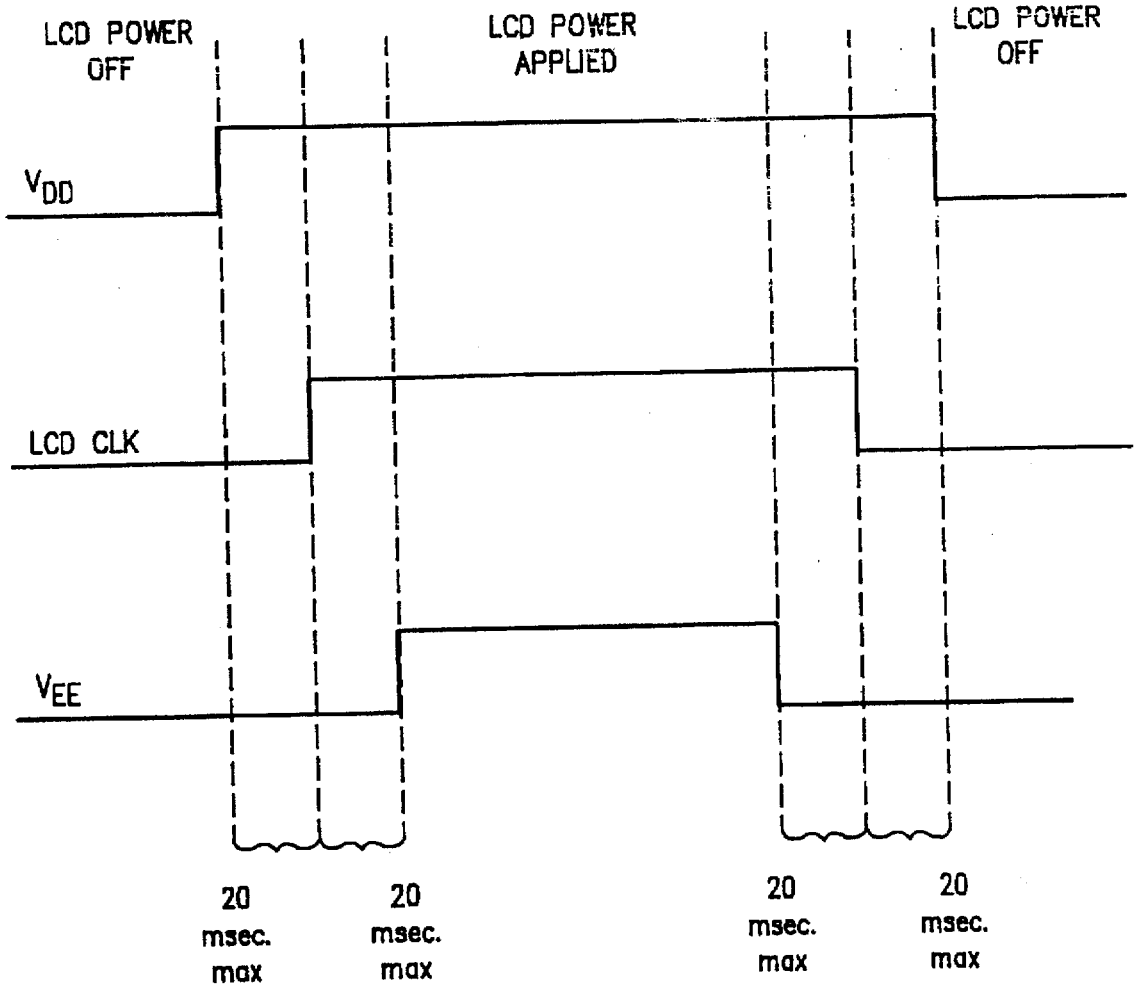
FIG. 12 is a timing diagram illustrating a power application sequence for a system embodying the LCD protection circuit shown in FIG. 1.

It is important that power be applied to the LCD display in the proper sequence, otherwise damage can result. To prevent damage to the LCD panel, the external DC power supplied to the LCD Display (VEE) should be disabled before the LCD controller's clock is disabled. Referring to FIG. 12, the power-up sequence is as follows: 1) Configure the LCD control registers; 2) Apply $V_{DD}$ (5V or 3V) to the display; 3) Enable the LCD clock from the power management registers—this should be done within 20 msec. of applying $V_{DD}$; 4) Enable the LCD controller; and, 5) Within 20 msec. max after applying the LCD clock, apply $V_{EE}$ (22V/–26V) to the display. The power-down sequence is as follows: 1) Remove $V_{EE}$ from the display; 2) Disable the LCD controller; 3) Within 20 msec. of removing $V_{EE}$, disable the LCD clock; and, 4) Within 20 msec. of removing the LCD clock, remove $V_{DD}$ from the display. The LCD clock should not be disabled when the LCD is enabled.

The invention embodiments described herein have been implemented in an integrated circuit which includes a number of additional functions and features which are described in the following co-pending, commonly assigned patent applications, the disclosure of each of which is incorporated herein by reference: U.S. patent application Ser. No. 08/451,319, entitled "DISPLAY CONTROLLER CAPABLE OF ACCESSING AN EXTERNAL MEMORY FOR GRAY SCALE MODULATION DATA" (atty. docket no. NSC1-62700); U.S. patent application Ser. No. 08/451,965, entitled "SERIAL INTERFACE CAPABLE OF OPERATING IN TWO DIFFERENT SERIAL DATA TRANSFER MODES" (atty. docket no. NSC1-62800); U.S. patent application Ser. No. 08/453,076, entitled "HIGH PERFORMANCE MULTIFUNCTION DIRECT MEMORY ACCESS (DMA) CONTROLLER" (atty. docket no. NSC1-62900); U.S. patent application Ser. No. 08/452,001, entitled "OPEN DRAIN MULTI-SOURCE CLOCK GENERATOR HAVING MINIMUM PULSE WIDTH" (atty. docket no. NSC1-63000); U.S. patent application Ser. No. 08/451,503, entitled "INTEGRATED CIRCUIT WITH MICROPROCESSOR AND PERIPHERAL CONTROLLERS FOR EMBEDDED CONTROL" (atty. docket no. NSC1-63100); U.S. patent application Ser. No. 08/451,924, entitled "EXECUTION UNIT ARCHITECTURE TO SUPPORT x86 INSTRUCTION SET AND x86 SEGMENTED ADDRESSING" (atty. docket no. NSC1-63300); U.S. patent application Ser. No. 08/451,444, entitled "BARREL SHIFTER" (atty. docket no. NSC1-63400); U.S. patent application Ser. No. 08/451,204, entitled "BIT SEARCHING THROUGH 8, 16, OR 32-BIT OPERANDS USING A 32-BIT DATA PATH" (atty. docket no. NSC1-63500); U.S. patent application Ser. No. 08/451,195, entitled "DOUBLE PRECISION (64-BIT) SHIFT OPERATIONS USING A 32-BIT DATA PATH" (atty. docket no. NSC1-63600); U.S. patent application Ser. No. 08/451,571, entitled "METHOD FOR PERFORMING SIGNED DIVISION" (atty. docket no. NSC1-63700); U.S. patent application Ser. No. 08/452,162, entitled "METHOD FOR PERFORMING ROTATE THROUGH CARRY USING A 32-BIT BARREL SHIFTER AND COUNTER" (atty. docket no. NSC1-63800); U.S. patent application Ser. No. 08/451,434, entitled "AREA AND TIME EFFICIENT FIELD EXTRACTION CIRCUIT" (atty. docket no. NSC1-63900); U.S. patent application Ser. No. 08/451,535, entitled "NON-ARITHMETICAL CIRCULAR BUFFER CELL AVAILABILITY STATUS INDICATOR CIRCUIT" (atty. docket no. NSC1-64000); U.S. patent application Ser. No. 08/445,563, entitled "TAGGED PREFETCH AND INSTRUCTION DECODER FOR VARIABLE LENGTH INSTRUCTION SET AND METHOD OF OPERATION" (atty. docket no. NSC1-64100); U.S. patent application Ser. No. 08/450,153 entitled "PARTITIONED DECODER CIRCUIT FOR LOW POWER OPERATION" (atty. docket no. NSC1-64200); U.S. patent application Ser. No. 08/451,495, entitled "CIRCUIT FOR DESIGNATING INSTRUCTION POINTERS FOR USE BY A PROCESSOR DECODER" (atty. docket no. NSC1-64300); U.S. patent application Ser. No. 08/451,219, entitled "CIRCUIT FOR GENERATING A DEMAND-BASED GATED CLOCK" (atty. docket no. NSC1-64500); U.S. patent application Ser. No. 08/451,214, entitled "INCREMENTOR/DECREMENTOR" (atty. docket no. NSC1-64700); U.S. patent application Ser. No. 08/451,150, entitled "A PIPELINED MICROPROCESSOR THAT ACCESSES AN EXTERNAL MEMORY IN A SINGLE CLOCK CYCLE" (atty. docket no. NSC1-64800); U.S. patent application Ser. No. 08/451,198, entitled "CODE BREAKPOINT DECODER" (atty. docket no. NSC1-64900); U.S. patent application Ser. No. 08/445,569, entitled "TWO TIER PREFETCH BUFFER STRUCTURE AND METHOD WITH BYPASS" (atty. docket no. NSC1-65000); U.S. patent application Ser. No. 08/445,564, entitled "INSTRUCTION LIMIT CHECK FOR MICROPROCESSOR" (atty. docket no. NSC1-65100); U.S. patent application Ser. No. 08/452,306, entitled "A PIPELINED MICROPROCESSOR THAT MAKES MEMORY REQUESTS TO A CACHE MEMORY AND AN EXTERNAL MEMORY CONTROLLER DURING THE SAME CLOCK CYCLE" (atty. docket no. NSC1-65200); U.S. patent application Ser. No. 08/452,080, entitled "APPARATUS AND METHOD FOR EFFICIENT COMPUTATION OF A 486™ MICROPROCESSOR COMPATIBLE POP INSTRUCTION" (atty. docket no. NSC1-65700); U.S. patent application Ser. No. 08/450,154, entitled "APPARATUS AND METHOD FOR EFFICIENTLY DETERMINING ADDRESSES FOR MISALIGNED DATA STORED IN MEMORY" (atty. docket no. NSC1-65800); U.S. patent application Ser. No. 08/451,742, entitled "METHOD OF IMPLEMENTING FAST 486™ MICROPROCESSOR COMPATIBLE STRING OPERATION" (atty. docket no. NSC1-65900); U.S. patent application Ser. No. 08/452,659, entitled "A PIPELINED MICROPROCESSOR THAT PREVENTS THE CACHE FROM BEING READ WHEN THE CONTENTS OF THE CACHE ARE INVALID" (atty. docket no. NSC1-66000); U.S. patent application Ser. No. 08/451,507, entitled "DRAM CONTROLLER THAT REDUCES THE TIME REQUIRED TO PROCESS MEMORY REQUESTS" (atty. docket no. NSC1-66300); U.S. patent application Ser. No. 08/451,420, entitled "INTEGRATED PRIMARY BUS AND SECONDARY BUS CONTROLLER WITH REDUCED PIN COUNT" (atty. docket no. NSC1-66400); U.S. patent application Ser. No. 08/452,365, entitled "SUPPLY AND INTERFACE CONFIGURABLE INPUT/OUTPUT BUFFER" (atty. docket no. NSC1-66500); U.S. patent application Ser. No. 08/451,744, entitled "CLOCK GENERATION CIRCUIT FOR A DISPLAY CONTROLLER HAVING A FINE TUNEABLE FRAME RATE" (atty. docket no. NSC1-66600); U.S. patent application Ser. No. 08/451,206, entitled "CONFIGURABLE POWER MANAGEMENT SCHEME" (atty. docket no. NSC1-66700); U.S. patent application Ser. No. 08/452,350, entitled "BIDIRECTIONAL PARALLEL SIGNAL INTERFACE" (atty. docket no. NSC1-67000); U.S. patent application Ser. No. 08/452,094, entitled "LIQUID CRYSTAL DISPLAY (LCD) PROTECTION CIRCUIT" (atty. docket no. NSC1-67100); U.S. patent application Ser. No. 08/450,156, entitled "DISPLAY CONTROLLER CAPABLE OF ACCESSING GRAPHICS DATA FROM A SHARED SYSTEM MEMORY" (atty. docket no. NSC1-67500); U.S. patent application Ser. No. 08/450,726, entitled "INTEGRATED CIRCUIT WITH TEST SIGNAL BUSES AND TEST CONTROL CIRCUITS" (atty. docket no. NSC1-67600); U.S. patent application Ser. No. 08/445,568, entitled "DECODE BLOCK TEST METHOD AND APPARATUS" (atty. docket no. NSC1-68000).

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A display protection circuit, comprising:

a first OR gate which receives a first pulse at one input and a first clock signal at another input;

a second OR gate which receives the first pulse at one input and a second clock signal at another input;

a first monostable multivibrator, coupled to the first OR gate, which receives an output of the first OR gate and which generates a second pulse in response thereto;

a second monostable multivibrator, coupled to the second OR gate, which receives an output of the second OR gate and which generates a third pulse in response thereto; and a first logic gate coupled to the first and second monostable multivibrators, which generate a fourth pulse which changes state in response to one of the first and second clock signals stopping transitioning for a first predetermined period of time.

2. A display protection circuit in accordance with claim 1, wherein the fourth pulse also changes state in response to one of the first and second clock signals does not start transitioning for a second predetermined period of time.

3. A display protection circuit in accordance with claim 1, wherein the first logic gate comprises a NAND gate.

4. A display protection circuit in accordance with claim 1, further comprising:

a third monostable multivibrator, coupled to the first and second OR gates, which receives an enable signal and which generates the first pulse in response thereto.

5. A display protection circuit in accordance with claim 4, wherein the fourth pulse is used to reset the enable signal.

6. A display protection circuit in accordance with claim 5, further comprising:

a first flip-flop, coupled to the first logic gate, which receives the fourth pulse and which generates a fifth pulse used to reset the enable signal.

7. A display protection circuit in accordance with claim 1, wherein the first and second monostable multivibrators are retriggerable monostable multivibrators.

8. A display protection circuit, comprising:

a first monostable multivibrator which receives an enable signal and which generates a first pulse in response thereto;

a first OR gate, coupled to the first monostable multivibrator, which receives the first pulse at one input and a first clock signal at another input;

a second OR gate, coupled to the first monostable multivibrator, which receives the first pulse at one input and a second clock signal at another input;

a second monostable multivibrator, coupled to the first OR gate, which receives an output of the first OR gate and which generates a second pulse in response thereto;

a third monostable multivibrator, coupled to the second OR gate, which receives an output of the second OR gate and which generates a third pulse in response thereto;

a NAND gate, coupled to the second and third monostable multivibrators, which NANDs the second and third pulses together to generate a fourth pulse; and a first flip-flop, coupled to the NAND gate, which receives the fourth pulse and which generates a fifth pulse used to reset the enable signal.

9. A display protection circuit in accordance with claim 8, further comprising:

a buffer circuit coupled to receive the enable signal which generates the first and second clock signals in response to the enable signal.

10. A display protection circuit in accordance with claim 8, further comprising:

a first AND gate, coupled to the first flip-flop, which receives the fourth pulse and which ANDs the fourth pulse with a reset signal used to reset the enable signal.

11. A display protection circuit in accordance with claim 8, wherein the first monostable multivibrator is a non-retriggerable monostable multivibrator, and the second and third monostable multivibrators are retriggerable monostable multivibrators.

* * * * *